US006242898B1

(12) United States Patent
Shimizu et al.

(10) Patent No.: US 6,242,898 B1
(45) Date of Patent: Jun. 5, 2001

(54) START-UP CIRCUIT AND VOLTAGE SUPPLY CIRCUIT USING THE SAME

(75) Inventors: Yasuhide Shimizu; Tomoyuki Nasu, both of Nagasaki (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/593,300

(22) Filed: Jun. 13, 2000

(30) Foreign Application Priority Data

Sep. 14, 1999 (JP) ..... 11-260735

(51) Int. Cl.[7] ..... G05F 3/16
(52) U.S. Cl. ..... 323/313; 323/901
(58) Field of Search ..... 323/312, 313, 323/314, 901; 363/49

(56) References Cited

U.S. PATENT DOCUMENTS 4,839,535 * 6/1989 Miller ..... 327/539
4,857,823 * 8/1989 Bitting ..... 323/314
5,367,249 * 11/1994 Honnigford ..... 323/313
6,002,242 * 12/1999 Migliavacca ..... 323/312
6,084,388 * 7/2000 Toosky ..... 323/313

* cited by examiner

*Primary Examiner*—Adolf Deneke Berhane
(74) *Attorney, Agent, or Firm*—Ronald P. Kananen; Rader, Fishman & Grauer

(57) ABSTRACT

A start-up circuit supplying a start-up current to a band gap reference voltage circuit at the time of start-up so as to start the band gap reference voltage circuit reliably, which stops the supply of the start-up current after the band gap reference voltage circuit starts operation in response to an output voltage of an operational amplifier supplied as the reference voltage of the band gap reference voltage circuit and, further, a voltage supply circuit, including such a start-up circuit and a band gap reference voltage circuit, which operates under the control of a feedback loop formed by the operational amplifier and outputs a constant voltage without dependency on the power supply voltage and the temperature.

23 Claims, 14 Drawing Sheets

EVEN NUMBER OF INVERTERS

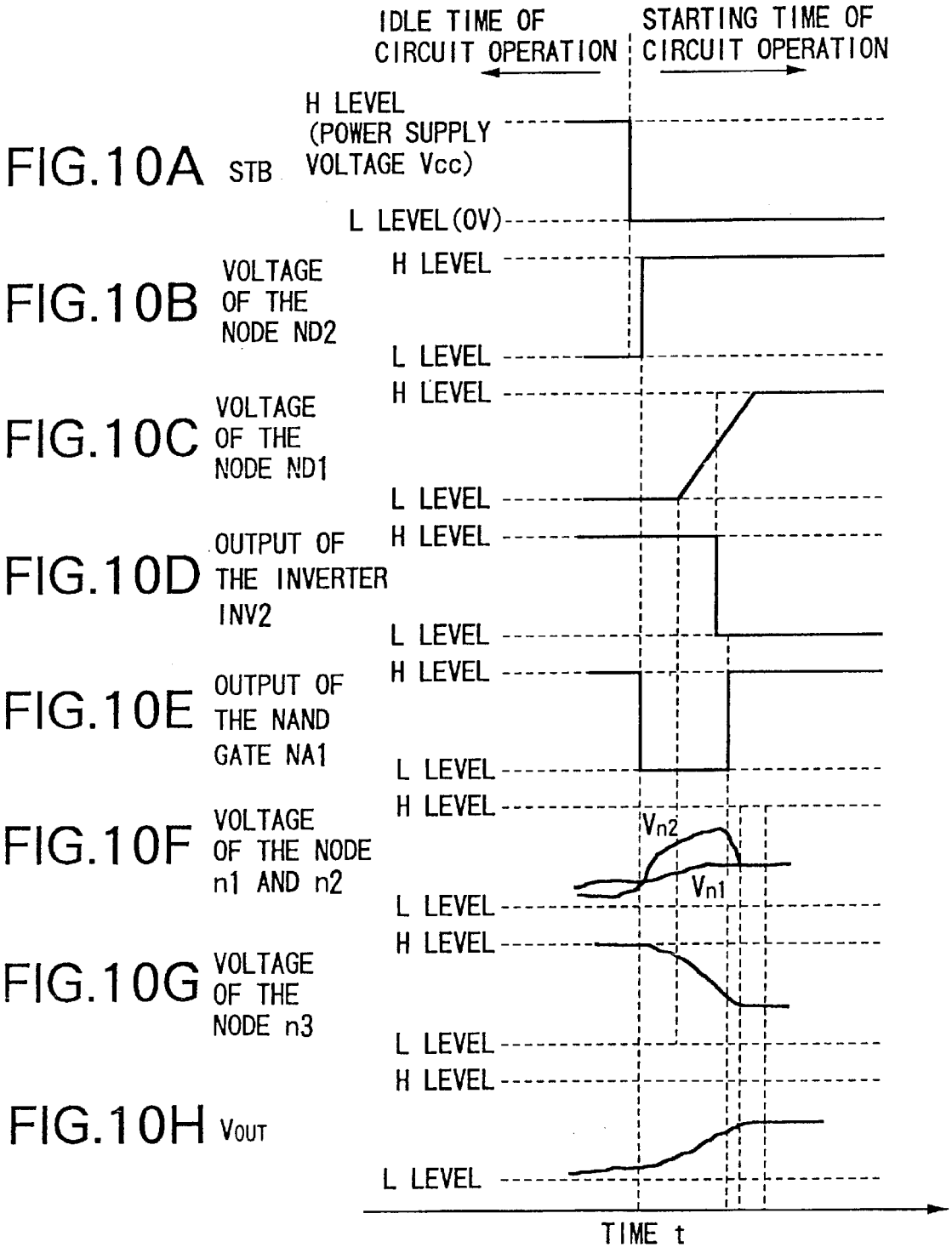
IDLE TIME OF CIRCUIT OPERATION
STARTING TIME OF CIRCUIT OPERATION
FIG.10A STB
H LEVEL (POWER SUPPLY VOLTAGE Vcc)
L LEVEL(0V)
FIG.10B VOLTAGE OF THE NODE ND2
H LEVEL
L LEVEL
FIG.10C VOLTAGE OF THE NODE ND1
H LEVEL
L LEVEL
FIG.10D OUTPUT OF THE INVERTER INV2
H LEVEL
L LEVEL
FIG.10E OUTPUT OF THE NAND GATE NA1
H LEVEL
L LEVEL
FIG.10F VOLTAGE OF THE NODE n1 AND n2
H LEVEL
Vn2
Vn1
L LEVEL
FIG.10G VOLTAGE OF THE NODE n3
H LEVEL
L LEVEL
FIG.10H VOUT
H LEVEL
L LEVEL
TIME t

START-UP CIRCUIT AND VOLTAGE SUPPLY CIRCUIT USING THE SAME

BACKGROUND OF THE INVENTION

1. Field of the Invention

The present invention relates to a start-up circuit built in a voltage supply circuit, for example, a band gap reference voltage circuit, and operating at the time of start-up of the band gap reference voltage circuit so as to make the reference voltage circuit start up more reliably and to a voltage supply circuit constituted using the same.

2. Description of the Related Art

In the past, in a band gap reference voltage circuit utilizing feedback of an operational amplifier circuit (hereinafter simply referred to as an "operational amplifier") or other circuit which does not start operating normally until some sort of signal is given in the feedback loop of the operational amplifier at the time of start-up of the circuit, a start-up circuit which is simple in configuration and able to make the circuit start up reliably has been considered necessary.

FIG. 1 is a circuit diagram of an example of a voltage supply circuit including a start-up circuit of the related art.

As illustrated, the voltage supply circuit of this related art is constituted by a start-up circuit 10 and a band gap reference voltage circuit 20. The start-up circuit 10 is constituted by an inverter INV101, a NAND gate NA101, and a delay circuit D101. Note that pMOS transistors T104, T105 and an inverter INV102 also contribute to the operation of the band gap reference voltage circuit 20, so the circuit formed by these circuit elements is also considered as a constituent part of the start-up circuit.

When receiving a standby signal STB, the start-up circuit 10 generates signals S1 and S2 for making the band gap reference voltage circuit 20 operate reliably in response to the standby signal STB.

The band gap reference voltage circuit 20 is constituted by an operational amplifier OPA1, pMOS transistors T101, T102, and T103, and diode-connected npn transistors B101, B102, and B013.

The transistor T101, the resistor R101, and the diode-connected transistor B101 are connected in series between the supply line of the power supply voltage $V_{CC}$ and a reference potential, for example, the supply line of the ground potential GND, the transistor T102 and the diode-connected transistor B102 are connected in series between the supply line of the power supply voltage $V_{CC}$ and the ground potential GND, and the transistor T103, the resistor R102, and the diode-connected transistor B103 are connected in series between the supply line of the power supply voltage $V_{CC}$ and the ground potential GND. The transistors T101, T102, and T103 are together connected at their gates to an output terminal of the operational amplifier OPA1 and output currents I1, I2, and I3 in accordance with an output signal of the operational amplifier OPA1.

The positive input terminal (+) of the operational amplifier OPA1 is connected to a node n1 between the transistor T101 and the resistor R101, while the negative input terminal (−) is connected to a node n2 between the transistor T102 and transistor B102. The output signal of the operational amplifier OPA1 is supplied to the gates of the transistors T101, T102, and T103. For this reason, a feedback loop is formed by the operational amplifier OPA1. By the control of the feedback loop, during normal operation, the currents I1, I2, and I3 of the transistors T101, T102, and T103 are controlled so that the voltages of the nodes n1 and n2 become equal.

In the standby (idle) state, the output terminal of the operational amplifier OPA1, that is, the node n3, is kept in a high impedance state. During this time, since the standby signal STB is at a high level, the output terminal of the inverter INV102 is held at a low level and the transistor T105 turns on, so the node n3 is held substantially at the level of the power supply voltage $V_{CC}$. Consequently, since the transistors T101, T102, and T103 turn off and no DC current flows, the voltages of the nodes n1 and n2 are not stable. When starting operation, as the standby signal STB switches from the high level to the low level, the output terminal of the inverter INV102 switches from the low level to the high level, so the transistor T105 turns off and the operational amplifier OPA1 controls the voltage of the node n3 in accordance with the input voltages of the nodes n1 and n2. Accordingly, the currents I1, I2, and I3 of the transistors T101, T102, and T103 are controlled.

If there were no start-up circuit and the voltage of the node n1 were higher than the voltage of the node n2, that is, $V_{n1}>V_{n2}$, the operational amplifier OPA1 would continuously output a signal of the high level since the voltage input to the positive input terminal (+) is higher than the voltage supplied to the negative input terminal (−). In such a situation, the band gap reference voltage circuit 20 cannot operate normally.

As described above, the standby signal STB is held at the high level when the voltage supply circuit is idling and is switched from the high level to the low level when the voltage supply circuit starts operating. Accordingly, the illustrated start-up circuit 10 outputs a signal S1 at a low level from the trailing edge of the standby signal STB during the delay time Δtd of the delay circuit D101. At other times, the standby signal STB is held at the high level.

While the signal S1 is at the low level, the transistor T104 is on, so the current flowing through the transistor T104 is input to the node n2. The emitter area of the diode-connected transistor B101 is made larger than the emitter area of the transistor B102. For this reason, when the same currents flow through these transistors or a current only flows through the transistor B102, the voltage $V_{n2}$ of the node n2 always becomes higher than the voltage $V_{n1}$ of the node n1 at the beginning of the operation. As a result, in the operational amplifier OPA1, the voltage input to the negative input terminal (−) is higher than that input to the positive input terminal (+) and the output signal is held at the low level. According to this, the transistors T101, T102, and T103 turn on, and the currents I1, I2, and I3 are output.

The signal S1 input to the gate of the transistor T104 is held at the low level for exactly the time set by the delay time Δtd of the delay circuit D101, then is switched to the high level. Since the transistor T104 is on for exactly the period when the signal S1 is at the low level and then turns off, the band gap reference voltage circuit 20 is controlled by the feedback loop formed by the operational amplifier OPA1, and a stable voltage $V_{OUT}$ is output from the output terminal $T_{OUT}$ free from any dependency on the power supply voltage $V_{CC}$ and temperature.

Summarizing the problem to be solved by the invention, in the voltage supply circuit of the related art described above, due to the control by the start-up circuit 10 after start-up so as to turn off the transistor T105 and to turn on the transistor T104 for exactly a certain constant time and then turn it off, normal start-up becomes possible regardless of the voltages of the node n1 and n2 while idle. Here, if the transistor T014 is held in the on state, since the feedback loop formed by the operational amplifier OPA1 cannot operate normally and the operational amplifier OPA1 cannot control the transistors T101, T102, and T103, the control signal S1 for controlling the on time of the transistor T104 is generated according to the delay time of the delay circuit D101.

However, since the timing of the switching of the level of the signal S1 is set by experience rather than after confirming the operational state of the band gap reference voltage circuit 20, it is not always set to the optimum value. If the switching time is too long, the start-up time of the voltage supply circuit becomes unnecessarily long and the start-up characteristic deteriorates, while if the switching time is too short, the start-up circuit stops before the voltage of the node n2 becomes sufficiently high which causes a possibility that the band gap reference circuit 20 will not start up normally.

Accordingly, careful attention is required when designing the start-up circuit. Further there are the drawbacks of susceptibility to manufacturing variance and variance in the operating conditions.

SUMMARY OF THE INVENTION

An object of the present invention is to provide a start-up circuit which is simple in structure, easy to design, resistant to manufacturing variance, free from temperature and power supply voltage dependency, and can suppress the power consumption to the minimum necessary extent.

Another object of the present invention is to provide a voltage supply circuit using the above start-up circuit.

To achieve the first object, according to a first aspect of the present invention, there is provided a start-up circuit for supplying a start-up current to a predetermined functional circuit to start the functional circuit, comprising a start-up current supply means for supplying the start-up current to the functional circuit in response to a start-up signal and a start-up control means for stopping the supply of the start-up current by the start-up current supply means when the voltage of a predetermined operational node reaches a predetermined reference value.

To achieve the second object, according to a second aspect of the present invention, there is provided a voltage supply circuit comprising a start-up current supply means for supplying a start-up current in response to a start-up signal, a voltage generating circuit for outputting a stable voltage during normal operation in response to the start-up current, and a start-up control means for stopping the supply of the start-up current by the start-up current supply means when the voltage of a predetermined operational node of the voltage generating circuit reaches a predetermined reference value.

According to a third aspect of the present invention, there is provided a voltage supply circuit comprising a first current supply transistor connected between a supply line of a power supply voltage and a first node, a first resistor and a first diode connected in series between the first node and a reference potential line, the first diode being in a forward direction toward the reference potential line, a second current supply transistor connected between the supply line of the power supply voltage and a second node, a second diode connected between the second node and the reference potential line, the second diode being in a forward direction toward the reference potential line, a third current supply transistor connected between the supply line of the power supply voltage and a third node, a second resistor and a third diode connected in series between the third node and the reference potential line, the third diode being in a forward direction toward the reference potential line, an amplifier with a first input terminal connected to the first node, with a second input terminal connected to the second node, and supplying a voltage signal in response to the difference between the input signals of the first and the second input terminals to the control terminals of the first, second, and third current supply transistors, a start-up current supply means supplying a start-up current to the second node in response to a start-up signal at the time of start-up, and a start-up control means for stopping the supply of the start-up current when the output voltage of the amplifier reaches a predetermined reference value.

Preferably, the start-up control means includes a bistable circuit receiving the start-up signal as a first signal and the output voltage of the amplifier as a second signal and outputting an output signal having a first state or a second state respectively in response to the first signal and the second signal and a gate circuit outputting a signal which energizes or de-energizes the start-up current supply means, in response to a result of a logical operation of the start-up signal and the output signal of the bistable circuit. Further, the bistable circuit preferably comprises a first transistor and a second transistor connected in series between a supply line of a power supply voltage and a reference potential line, the output voltage of the amplifier is supplied to the gate of the first transistor, and the start-up signal is supplied to the gate of the second transistor.

According to a fourth aspect of the present invention, there is provided a voltage supply circuit comprising a first current supply transistor connected between a supply line of a power supply voltage and a first node, a second current supply transistor connected between the supply line of the power supply voltage and a second node, a first resistor and a first diode connected in series between the first node and a third node, the first diode being in a forward direction toward the third node, a second diode connected between the second node and the third node, the second diode being in a forward direction toward the third node, a second resistor connected between the third node and a reference potential line, an amplifier with a first input terminal connected to the first node, with a second input terminal connected to the second node, and supplying a voltage signal in response to the difference between the input signals of the first and the second input terminals to the control terminals of the first and the second current supply transistors, a start-up current supply means supplying a start-up current to the second node in response to a start-up signal at the time of start-up, and a start-up control means for stopping the supply of the start-up current when the output voltage of the amplifier reaches a predetermined reference value.

According to a fifth aspect of the present invention, there is provided a voltage supply circuit, comprising a first transistor group constituted by m (m is a natural number) number of current supply transistors connected in parallel between a supply line of a power supply voltage and a first node, a second transistor group constituted by n (n is a natural number) number of current supply transistors connected in parallel between the supply line of the power supply voltage and a second node, a first resistor and a first diode connected in series between the first node and a third node, the first diode being in a forward direction toward the third node, a second diode connected between the second node and the third node, the second diode being in a forward direction toward the third node, a second resistor connected between the third node and a reference potential line, an operational amplifier with a first input terminal connected to the first node, with a second input terminal connected to the second node, and supplying a voltage signal in response to the difference between the input signals of the first and the second input terminals to the control terminals of the transistors of the first and the second transistor groups, a start-up current supply means supplying a start-up current to the second node in response to a start-up signal at the time of start-up, and a start-up control means for stopping the supply of the start-up current when the output voltage of the amplifier reaches a predetermined reference value.

According to a sixth aspect of the present invention, there is provided a voltage supply circuit, comprising a first transistor group constituted by m (m is a natural number) number of current supply transistors connected in parallel between a supply line of a power supply voltage and a first node, a second transistor group constituted by n (n is a natural number) number of current supply transistors connected in parallel between the supply line of the power supply voltage and a second node, a first resistor and a first diode connected in series between the first node and a third node, the first diode being in a forward direction toward the third node, a second diode connected between the second node and the third node, the second diode being in a forward direction toward the third node, a second resistor connected between the third node and a reference potential line, a third transistor group constituted by j (j is a natural number) number of current supply transistors connected in parallel between the supply line of the power supply voltage and a fourth node, a third resistor and a third diode connected in series between the fourth node and the reference potential line, the third diode being in a forward direction toward the potential line, an amplifier with a first input terminal connected to the first node, with a second input terminal connected to the second node, and supplying a voltage signal in response to the difference between the input signals of the first and the second input terminals to the control terminals of the transistors of the first, second, and third transistor groups, a start-up current supply means supplying a start-up current to the second node in response to a start-up signal at the time of start-up, and a start-up control means for stopping the supply of the start-up current when the output voltage of the amplifier reaches a predetermined reference value.

BRIEF DESCRIPTION OF THE DRAWINGS

These and other objects and features of the present invention will become clearer from the following description of the preferred embodiments given with reference to the attached figures, in which:

FIGS. 10A to 10H are time charts of the voltage supply circuit shown in FIG. 8.

DESCRIPTION OF THE PREFERRED EMBODIMENTS

First Embodiment

Figure 1:
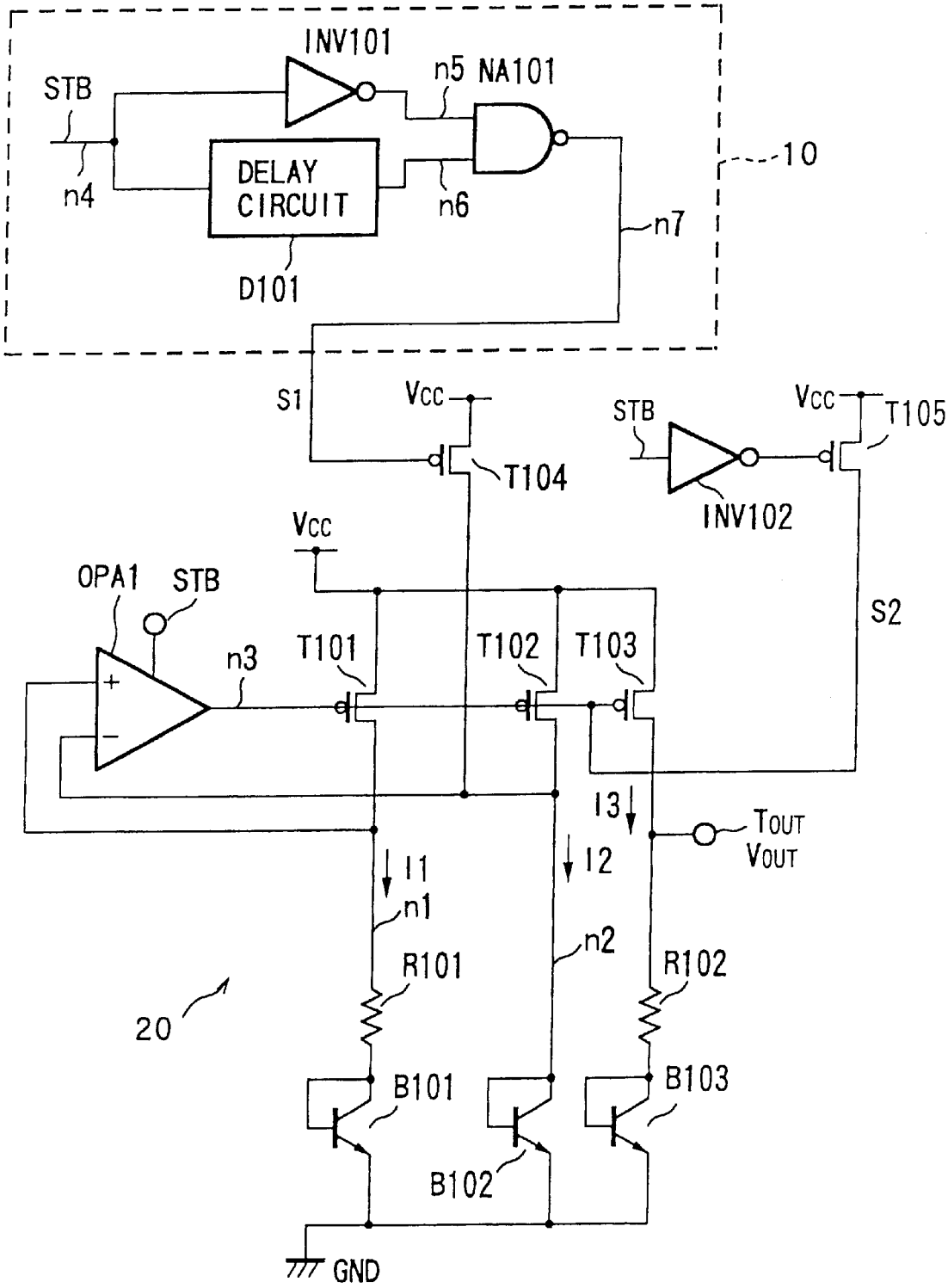
FIG.1 PRIOR ART
FIG. 1 is a circuit diagram of an example of a voltage supply circuit of the related art.
Figure 2:
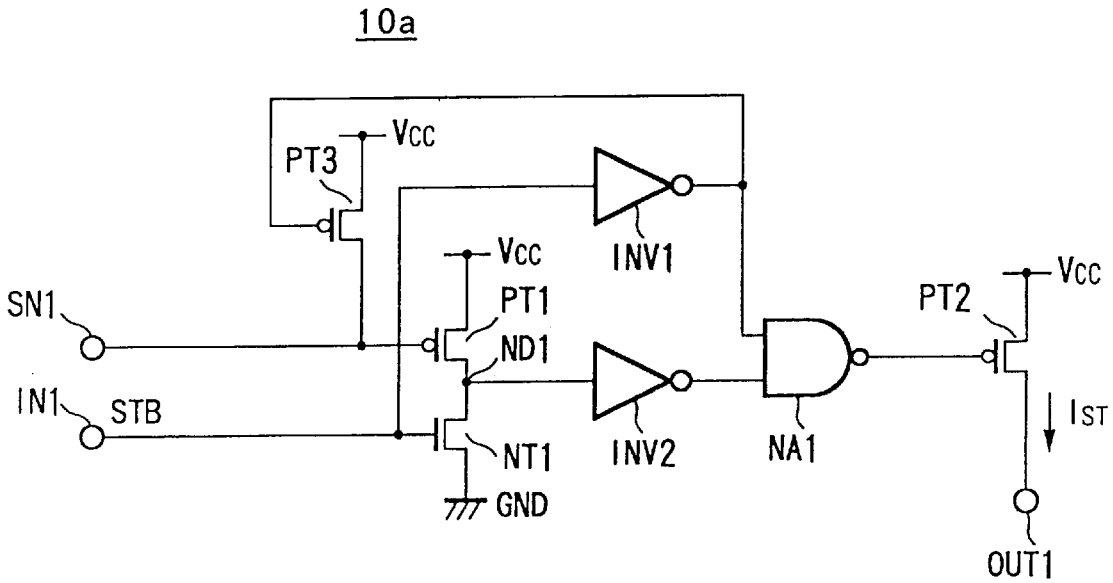
FIG. 2 is a circuit diagram of a start-up circuit according to a first embodiment of the present invention.

FIG. 2 is a circuit diagram of a start-up circuit according to a first embodiment of the present invention.

As illustrated, the start-up circuit 10*a* of the present embodiment Is constituted by pMOS transistors PT1, PT2, and PT1, a nMOS transistor NT1, inverters INV1, INV2, and a NAND gate NA1.

The transistors PT1 and NT1 are connected in series between the supply line of the power supply voltage $V_{CC}$ and the ground potential GND. The gate of the transistor PT1 is connected to a signal terminal SN1, while the gate of the transistor NT1 is connected to an input terminal IN1. The drains of the transistors PT1 and NT1 are connected to the node ND1.

The input terminal of the inverter INV1 is connected to the input terminal IN1, while the input terminal of the inverter INV2 is connected to the node ND1. The two input terminals of the NAND gate NA1 are connected to the output terminals of the inverter INV1 and INV2.

The gate of the transistor PT2 is connected to the output terminal of the NAND gate NA1, the source is connected to the supply line of the power supply voltage $V_{CC}$, and the drain is connected to the output terminal OUT1.

The gate of the transistor PT1 is connected to the output terminal of the inverter INV1, the source is connected to the supply line of the power supply voltage $V_{CC}$, and the drain is connected to the signal terminal SN1.

The start-up circuit 10*a* constituted in this way receives at its input terminal IN1 a standby signal STB set to a high level at the time of idling and to a low level after the start of operation, is connected at its output terminal OUT1 to an operational node requiring a temporary flow of current (rise of voltage) for start-up, and is connected at its signal terminal SN1 to an operational node requiring to e fixed at the voltage of the power supply voltage $V_{CC}$ at the time of idling and to be lowered from the power supply voltage $V_{CC}$ to a voltage sufficient for turning on the pMOS transistor after the start of operation.

Below, an explanation will be made of the operation of the start-up circuit of the present embodiment while referring to FIG. 2.

The standby signal STB is input to the input terminal IN1. The standby signal STB is held at the high level at the time of idling (standby state), while is switched to the low level after the circuit starts operating.

In the standby state, the output terminal of the inverter INV1 is at the low level. Further, the transistor NT1 is on, and the node ND1 is held at the low level, for example, the level of the ground potential GND. Since the output terminal of the NAND gate NA1 is held at the high level in response to the outputs of the inverters INV1, INV2, the transistor PT2 turns off.

On the other hand, since the gate of the transistor PT3 is at the low level, the transistor PT3 turns on and the signal teminal SN1 is held at the high level, for example, the level of or near the power supply voltage $V_{CC}$.

After the voltage supply circuit starts operation, the standby signal STB is switched from the high level to the low level. Accordingly, the transistor NT1 turns from on to off. The output terminal of the inverter INV1 switches from the low level to the high level, accordingly the transistor PT1 turns off, however, the signal terminal SN1 is held at the high level unless a new signal is input to the signal terminal SN1.

For this reason, since both the transistors PT1 and NT1 turn off, the node ND1 is in a high impedance state, and the voltage thereof is held at the low level without changing.

At this time, since both of the input terminals of the NAND gate NA1 are held at the high level, the output terminal is held at the low level. Accordingly, the transistor PT2 turns on, and a start-up current $I_{ST}$ is supplied to the output terminal OUT1.

In response to the current $I_{ST}$ supplied from the output terminal OUT1, for example, the band gap reference voltage circuit starts operation, and the voltage of the signal terminal SN1 starts to fall. When the voltage of the node becomes low enough to turn the transistor PT1 on, the transistor PT1 turns on, and the node ND1 is raised from the low level to a high level, for example, the level of or near the power supply voltage $V_{CC}$.

When the voltage of the node ND1 exceeds the logic threshold voltage of the inverter INV2, the output terminal of the inverter INV2 switches from the high level to the low level, accordingly the output terminal of the NAND gate NA1 switches from the low level to the high level. Consequently, the transistor PT2 turns off and the current supply to the output terminal OUT1 stops. After the start-up current $I_{ST}$ stops, the band gap reference voltage circuit operates normally.

As described above, the start-up circuit 10*a* of the present embodiment operates when the voltage supply circuit starts, for example, supplies the necessary start-up current $I_{ST}$ to the band gap reference voltage circuit. Since it stops operation after confirming the operation of the band gap reference voltage circuit, the voltage supply circuit can be started-up reliably. Further, since the supply of the start-up current $I_{ST}$, to the band gap stops automatically in response to the operational state of the band gap, the timing for supplying the start-up current $I_{ST}$ can be set appropriately, and the power consumption during the start-up can be reduced to a minimum necessary extent. The circuit construction is simple, the scope of application is wide, and the design is easy. Furthermore, there is resistance to variance in the manufacturing process.

Second Embodiment

Figure 3:
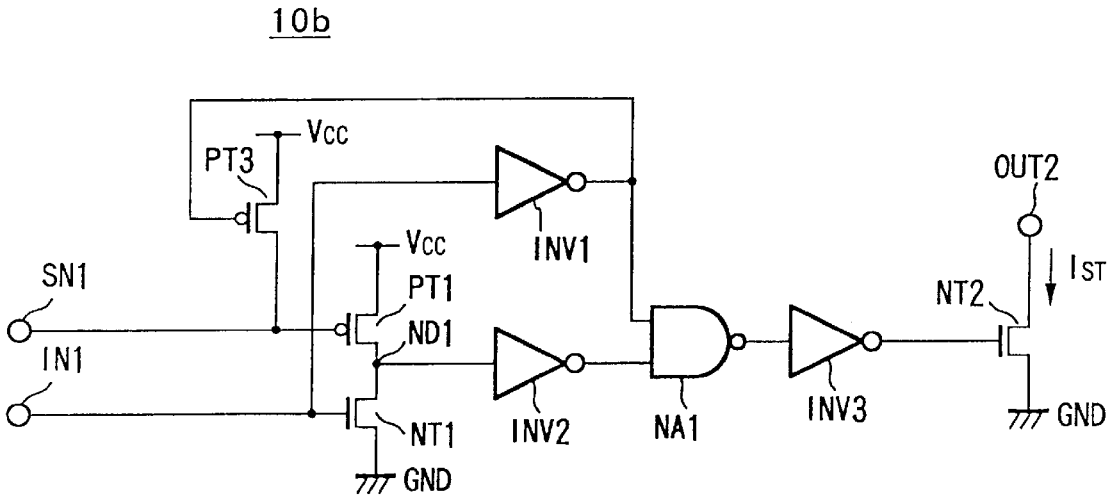
FIG. 3 is a circuit diagram of a start-up circuit according to a second embodiment of the present invention.

FIG. 3 is a circuit diagram of a start-up circuit according to a second embodiment of the present invention.

The start-up circuit 10*b* of the present embodiment differs from the start-up circuit of the first embodiment illustrated in FIG. 2 in the point that an inverter INV3 and an nMOS transistor NT2 are provided at the output side of the NAND gate NA1 instead of the pMOS transistor PT2. The other parts are substantially the same as those of the first embodiment shown in FIG. 2, so in FIG. 3, the same references are given to the same constituent parts.

As illustrated in FIG. 3, the input terminal of the inverter INV3 is connected to the output terminal of the NAND gate NA1, while the output terminal is connected to the gate of the transistor NT2. The source of the transistor NT2 is grounded, and the drain is connected to an output terminal OUT2.

The start-up circuit of the present embodiment is connected at the output terminal OUT2 to an operational node requiring draw-in of current (reduction of voltage) temporarily after the start of operation since a draw-in current flows to the output terminal OUT2 at the time of start-up.

Below, a brief explanation will be made of the operation of the start-up circuit 10*b* of the present embodiment by referring to FIG. 3.

In the standby state, the standby signal STB input to the input terminal IN1 is held at the high level. In accordance with this, the output terminal of the inverter INV1 is held at the low level, the transistor PT1 turns on, and the signal terminal SN1 is held at the high level. The transistor NT1 turns on, the node ND1 is held at the low level, and the output terminal of the inverter INV2 is at the high level. At this time, since the output terminal of the NAND gate NA1 is held at the high level, the output terminal of the inverter INV3 is at the low level and the transistor NT2 turns off.

After the circuit starts operation, the standby signal STB is switched from the high level to the low level. Accordingly, the output terminal of the inverter INV1 switches to the high level and the transistor PT3 turns off, however, the signal terminal SN1 is held at the high level unless a new signal is input to the signal terminal SN1.

On the other hand, the transistor NT1 turns off, the node ND1 is in the high impedance state, the voltage is held at the low level, and the output terminal of the inverter INV2 is held at the low level too.

For this reason, since both of the input terminals of the NAND gate NA1 are held at the high level, the output terminal is held at the low level, and the output terminal of the inverter INV3 is held at the high level, the transistor NT2 turns on, and a draw-in current flows into the output terminal OUT2.

In response to the draw-in current of the output terminal OUT2, for example, the band gap reference voltage circuit starts operation. Accordingly, the voltage of the signal terminal SN1 becomes lower. When the voltage becomes low enough to turn the transistor PT1 on, the transistor PT1 turns on and the node ND1 is raised from the low level to the high level. Consequently, the output signals of the inverter INV2, the NAND gate NA1, and the inverter INV3 successively switch in level and, as a result, the output terminal of the inverter INV3 becomes a low level and the transistor NT2 turns off.

After the transistor NT2 turns off, the draw-in current stops flowing to the output terminal OUT2. Since the band gap reference voltage circuit enters a normal operational state, the output voltage is stabilized by, for example, the feedback loop formed by the operational amplifier, and a predetermined voltage is supplied.

Third Embodiment

Figure 4:
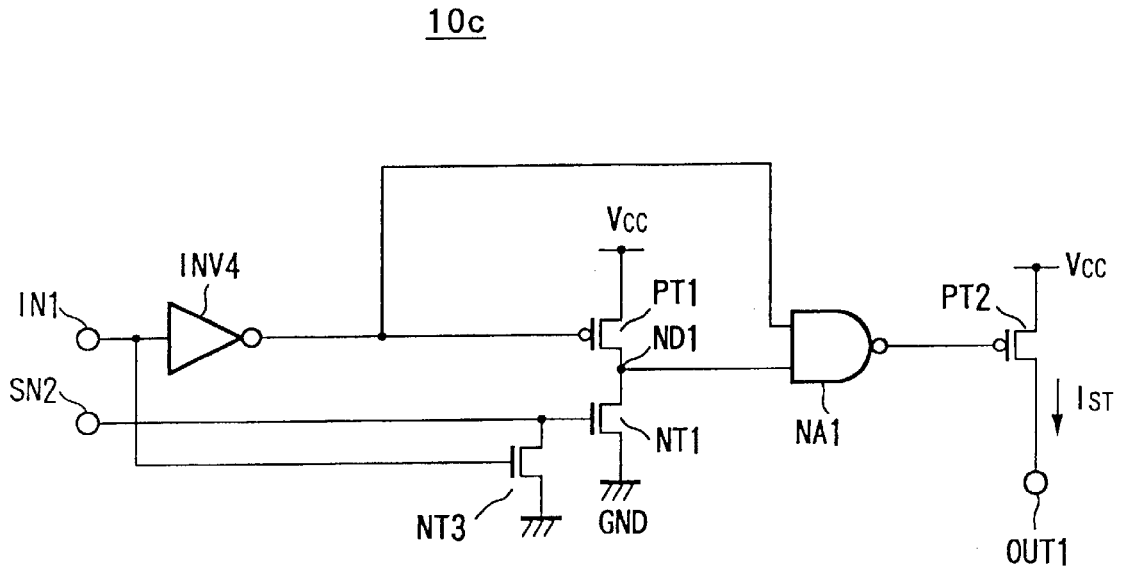
FIG. 4 is a circuit diagram of a start-up circuit according to a third embodiment of the present invention.

FIG. 4 is a circuit diagram of a start-up circuit according to a third embodiment of the present invention.

As illustrated, the start-up circuit 10*c* of the present embodiment is constituted by pMOS transistors PT1 and PT2, nMOS transistors NT1 and NT3, an inverter INV4, and a NAND gate NA1.

The transistors PT1 and NT1 are connected in series between the supply line of the power supply voltage $V_{CC}$ and the ground potential GND. The gate of the transistor PT1 is connected to the output terminal of the inverter INV4, while the gate of the transistor NT1 is connected to a signal terminal SN2. The drains of the transistors PT1 and NT1 are connected to the node ND1. Note that the input terminal of the inverter INV1 is connected to the input terminal IN1. The standby signal STB is input to the input terminal IN1.

The two input terminals of the NAND gate NA1 are connected to the node ND1 and the output terminal of the inverter INV4.

The gate of the transistor PT2 is connected to the output terminal of the NAND gate NA1, the source is connected to the supply line of the power supply voltage $V_{CC}$, and the drain is connected to the output terminal OUT1.

The gate of the transistor NT3 is connected to the input terminal IN1, the drain is connected to the signal terminal SN2, and the source is grounded.

The start-up circuit 10*c* of the present embodiment receives at its input terminal IN1 a standby signal STB set at the high level at the time of idling and at the low level after the start of operation. It is connected at the output terminal OUT1 to an operational node requiring draw-in of current temporarily for start-up and is connected at the signal terminal SN2 to an operational node requiring to be fixed at the ground potential GND at the time of idling and to be raised from the ground potential GND to a voltage high enough for turning on an nMOS transistor after the start of operation.

Below, an explanation will be made of the operation of the start-up circuit of the present embodiment by referring to FIG. 4.

In the standby state, since the standby signal STB of a high level is input, the output terminal of the inverter INV4 is at the low level and the transistor PT1 turns on. Note that since the transistor NT3 is on, the signal terminal SN2 is held at the low level, for example, the level of the ground potential GND, and the transistor NT1 turns on. For this reason, the node ND1 is held at substantially the level of the power supply voltage $V_{CC}$.

At this time, since the output terminal of the NAND gate NA1 is held at the high level, the transistor PT2 turns off.

After the voltage supply circuit starts operation, the standby signal STB is switched from the high level to the low level. Accordingly, the output terminal of the inverter INV4 switches from the low level to the high level, and the transistor PT1 turns off. On the other hand, the transistor NT3 turns off, the signal terminal SN2 is held at the low level, and the transistor NT1 is held at the off state. Consequently, the node ND1 is in a high impedance state, and the voltage thereof is held at the high level.

At this time, both of the input terminals of the NAND gate NA1 are held at the high level, the output terminal switches to the low level, and the transistor PT2 turns on. Accordingly, a start-up current $I_{ST}$ is supplied to the output terminal OUT1.

In response to the current $I_{ST}$, supplied from the output terminal OUT1, for example, the band gap reference voltage circuit starts operation, and the voltage of the signal terminal SN2 rises from the low level. When the voltage of the terminal SN2 rises to the threshold voltage of the transistor PN1, the transistor NT1 turns on, and the node ND1 switches from the high level to the low level. According to this, the output terminal of the NAND gate NA1 switches from the low level to the high level, the transistor PT2 turns off, and the supply of the start-up current stops. After the supply of the start-up current $I_{ST}$ stops, the band gap reference voltage circuit operates normally.

As described above, the start-up circuit 10*c* of the present embodiment operates when the voltage supply circuit starts, for example, supplies the necessary start-up current $I_{ST}$ to the band gap reference voltage circuit. Since it stops operation after confirming the operation of the band gap reference voltage circuit, the voltage supply circuit can be started up reliably.

Further, since the supply of the start-up current $I_{ST}$ to the band gap stops automatically in response to the operational state of the band gap, the timing for supplying the start-up current $I_{ST}$ can be set appropriately, and the power consumption during the start-up time can be reduced to a minimum. The circuit construction is simple, the scope of application is wide, and the design is easy. Furthermore, there is resistance to variance in the manufacturing process.

Fourth Embodiment

Figure 5:
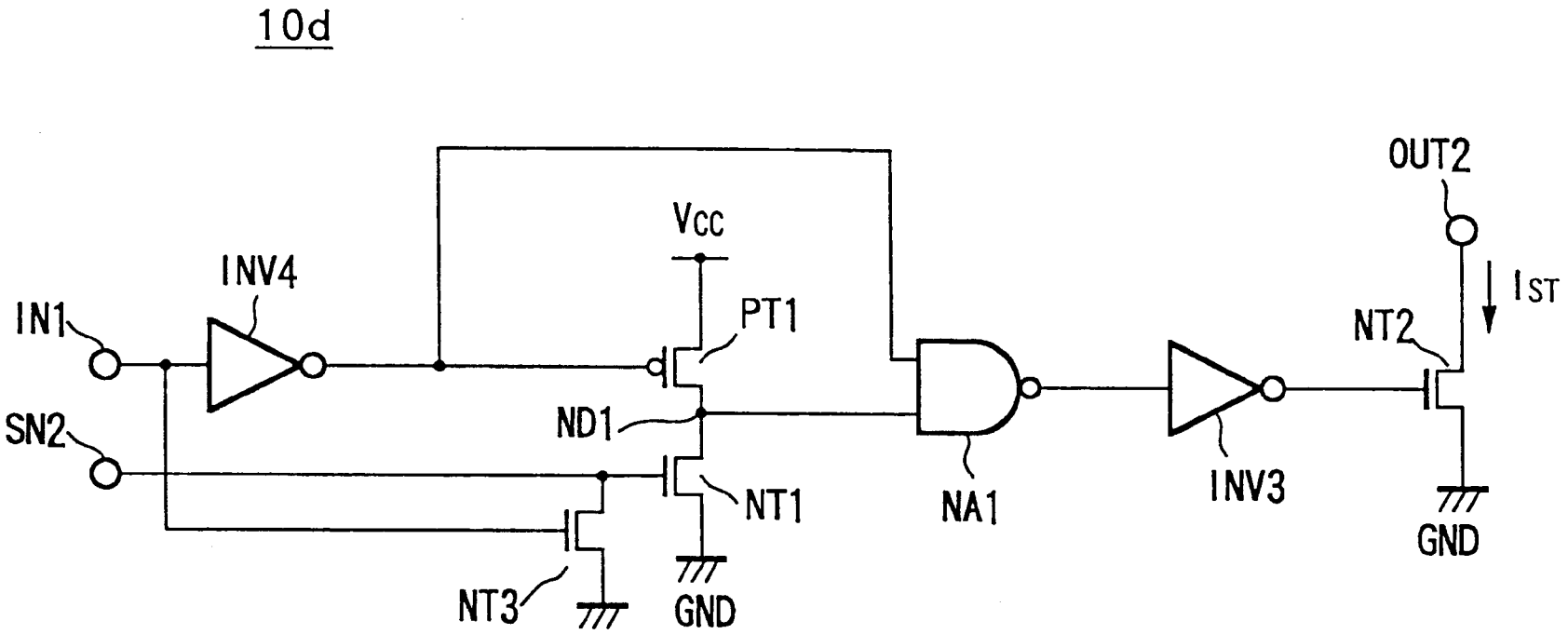
FIG. 5 is a circuit diagram of a start-up circuit according to a fourth embodiment of the present invention.

FIG. 5 is a circuit diagram of a start-up circuit according to a third embodiment of the present invention.

The start-up circuit 10*d* of the present embodiment differs from the start-up circuit of the third embodiment illustrated in FIG. 4 in the point that an inverter INV3 and an nMOS transistor NT2 are provided at the output side of the NAND gate NA1 instead of the pMOS transistor PT2. The other parts are substantially the same as those of the third embodiment shown in FIG. 4, so in FIG. 5 the same references are given to the same constituent parts.

As illustrated in FIG. 5, the input terminal of the inverter INV3 is connected to the output terminal of the NAND gate NA1, while the output terminal is connected to the gate of the transistor NT2. The source of the transistor NT2 is grounded, and the drain is connected to an output terminal OUT2.

The start-up circuit of the present embodiment is connected at the output terminal OUT2 to an operational node requiring draw-in of current (reduction of voltage) temporarily after the start of operation since a draw-in current flows to the output terminal OUT2 at the time of start-up.

Below, a brief explanation will be made of the operation of the start-up circuit 10*d* of the present embodiment by referring to FIG. 5.

In the standby state, the standby signal STB input to the input terminal IN1 is held at the high level. In accordance with this, the output terminal of the inverter INV4 is held at the low level, the transistor PT1 turns on, and the node ND1 is held at the high level. At this time, since the output terminal of the NAND gate NA1 is held at the high level, the output terminal of the inverter INV3 is at the low level and the transistor NT2 turns off.

After the circuit starts operation, the standby signal STB is switched from the high level to the low level. Accordingly, the output terminal of the inverter INV4 switches from the low level to the high level, and the transistor PT1 turns off. On the other hand, the transistor NT3 turns off, the signal terminal SN2 is held at the low level, and the transistor NT1 is held off. Consequently, the node ND1 is in the high impedance state, and the voltage thereof is held at the high level.

At this time, the output terminal of the NAND gate NA1 switches to the low level, accordingly the transistor NT2 turns on, and a draw-in current flows to the output terminal OUT2.

In response to the draw-in current $I_{ST}$ of the output terminal OUT2, for example, the band gap reference voltage circuit starts operation and the voltage of the signal terminal SN2 rises up from the low level. When the voltage of the terminal SN2 has risen to the threshold voltage of the transistor NT1, the transistor NT1 turns on, and the node ND1 switches from the high level to the low level. Consequently, the transistor NT2 turns off, and the draw-in current $I_{ST}$ stops. After that, the band gap reference voltage circuit starts normal operation and supplies a constant voltage of a predetermined level free of power supply voltage and temperature dependency.

Fifth Embodiment

Figure 6:
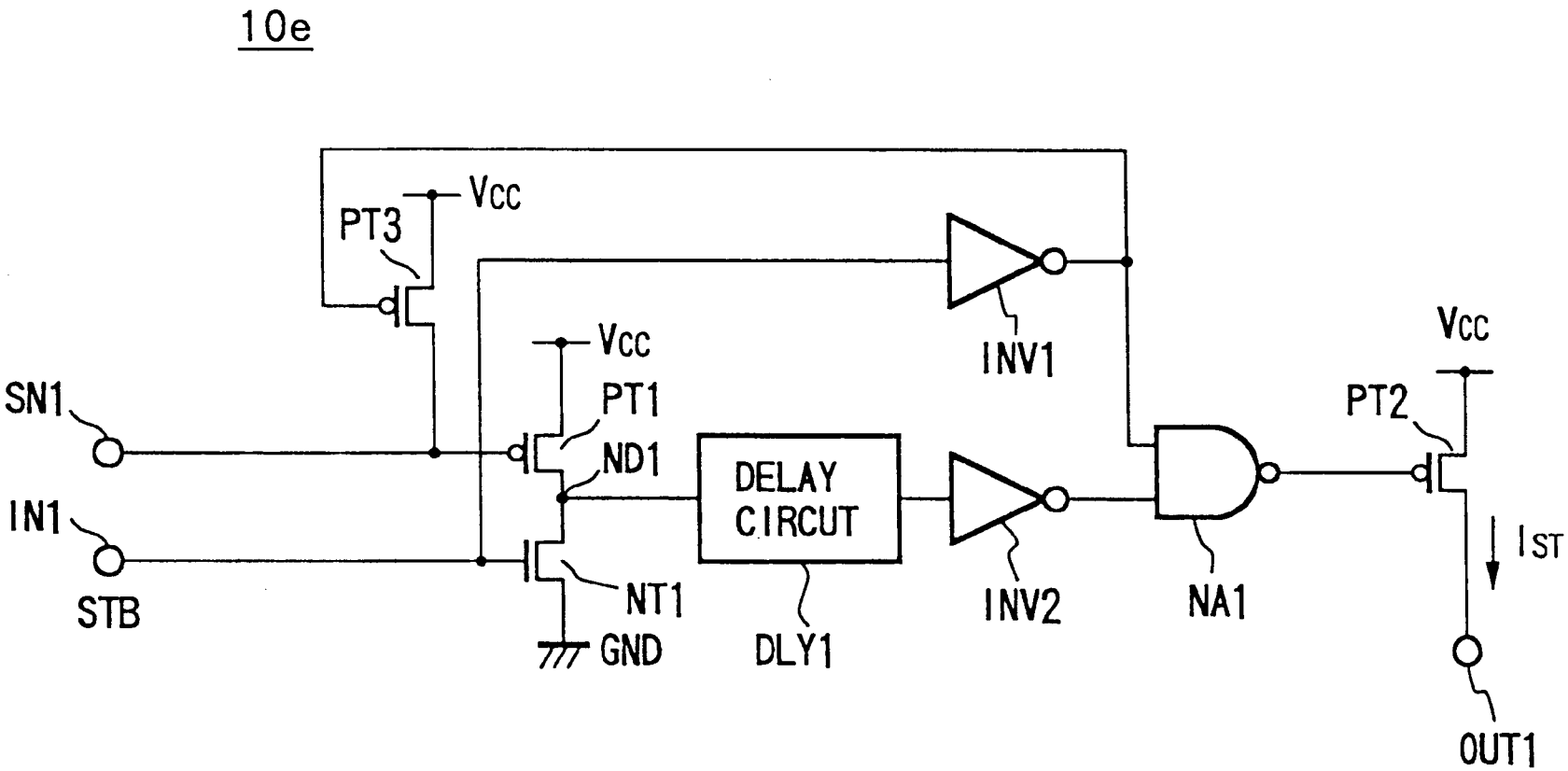
FIG. 6 is a circuit diagram of a start-up circuit according to fifth embodiment of the present invention.

FIG. 6 is a circuit diagram of a start-up circuit according to a fifth embodiment of the present invention.

The start-up circuit 10*e* of the present embodiment is substantially the same in configuration as the start-up circuit of the first embodiment illustrated in FIG. 2 expect that a delay circuit DLY1 is connected between the node ND1 and the inverter INV2. In FIG. 6, the same references are given to the same constituent parts as in FIG. 2.

Below, an explanation will be made of the configuration and operation of the start-up circuit 10*e* of the present embodiment focusing on the differences from the start-up circuit of the first embodiment.

As shown in FIG. 6, the input terminal of the delay circuit DLY1 is connected to the node ND1, while the output terminal is connected to the input terminal of the inverter INV2. Note that the delay circuit DLY1 is constituted by, for example, an even number of inverters connected in series or an RC circuit formed by a resistor and a capacitor.

Figure 7A:
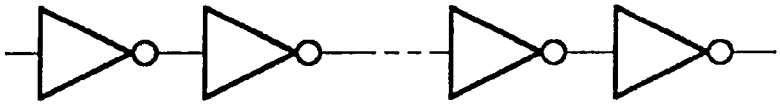
FIGS. 7A and 7B are circuit diagrams showing examples of a delay circuit.
Figure 7B:
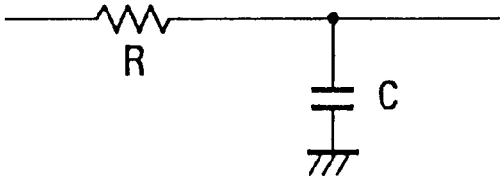

FIGS. 7A and 7B show two examples of the configuration of the delay circuit DLY1. As illustrated in FIG. 7A, the delay circuit DLY1-1 is constituted by an even number of inverters connected in series. In the case, the delay time Atd of the delay circuit DLY1-1 is determined by the delay times of the inverters.

The delay circuit DLY1-2 shown in FIG. 7B is constituted by a resistor R and a capacitor C. As illustrated, the delay circuit DLY1-2 has a configuration substantially the same as that of an integration circuit. The delay time of the delay circuit can be controlled by setting the resistance value of the resistor R and the capacitance value of the capacitor C.

Below, an explanation will be made of the operation of the start-up circuit 10*e*. Note that, as described above, the present embodiment is substantially comprised of the first embodiment plus the delay circuit DLY1 and operates substantially the same as with the first embodiment. Below, the operation in connection with the delay circuit will be explained.

First, in the standby state, the standby signal STB is at the high level, the transistor NT1 is on, and the node ND1 is held at the low level. At this time, the output terminal of the NAND gate NA1 is at the high level, and the transistor PT2 turns off.

After the voltage supply circuit starts operation, the standby signal STB switches from the high level to the low level. Accordingly, the transistor NT1 turns from on to off. The node ND1 is held at the low level, and the output signal thereof is at the low level too. In response to the level change of the standby signal STB, the output terminal of the inverter INV1 switches from the low level to the high level. At this time, since both of the input terminals of the NAND gate NA1 are held at the high level, the output terminal thereof is held at the low level. Consequently, the transistor PT2 turns on, and the start-up current $I_{ST}$ is supplied to the output terminal OUT1.

In response to the start-up current $I_{ST}$ supplied from the output terminal OUT1, for example, the band gap reference voltage circuit starts operation, and the voltage of the signal terminal SN1 becomes lower. When the voltage becomes low enough to turn the transistor PT1 on, the transistor PT1 turns on, the node ND1 is charged by the current flow from the transistor PT1, and the level thereof rises.

After the delay time Δtd of the delay circuit has elapsed, the output terminal of the delay circuit DLY1 switches from the low level to the high level too. According to this, the output signals of the inverter INV2 and the NAND gate NA1 successively switch in level. After the output signal of the NAND gate NA1 switches to the high level, the transistor PT2 turns off, and the supply of the start-up current $I_{ST}$ stops. After the supply of the start-up current $I_{ST}$ stops, the band gap reference voltage circuit starts operation normally, and a predetermined constant voltage is supplies to the external.

That is, the start-up circuit of the present embodiment supplies the start-up current to, for example, the band gap reference voltage circuit in response to the trailing edge of the standby signal STB and controls the supply of the start-up current in response to the level change of the signal terminal SN1. In the start-up circuit 10*a* illustrated in FIG. 2, when the voltage of the signal terminal SN1 falls and the transistor PT1 switches to the on state, the transistor PT2 turns off and the start-up current $I_{ST}$ stops. However, in the start-up circuit 10*e* of the present embodiment, when the delay time Δtd of the delay circuit DLY1 has elapsed after the voltage of the signal terminal SN1 falls and the transistor PT1 turns on, the transistor PT2 turns off and the supply of the start-up current $I_{ST}$ stops.

In the band gap reference voltage circuit constituting the voltage supply circuit, due to the operational conditions, variance in the manufacturing process, etc., the circuit reaches the normal operational state after a certain time has elapsed from when the voltage of the signal terminal SN1 falls and reaches a level to turn on the pMOS transistor. For this reason, if the supply of the start-up current $I_{ST}$ is stopped right after the voltage of the signal terminal SN1 falls to a predetermined value, there is possibility that the band gap reference voltage circuit cannot start normally. By using the start-up circuit of the present embodiment, since the time interval from when the voltage of the signal terminal SN1 reaches a predetermined value to when the supply of the start-up current stops can be appropriately controlled by adjusting the delay time of the delay circuit DLY1, the voltage supply circuit can be started up reliably.

Note that, in the logic parts of the start-up circuits of the embodiments described above, that is, the parts constituted by the inverters and the logic gates, for example, the NAND gates can be substituted by other logical circuits of substantially the equivalent logic or equivalent function. Even if equivalent circuits of the same logic or the same function are used, they of course have the same functions as start-up circuits.

Embodiment of Voltage Supply Circuit Using Start-up Circuit

Figure 8:
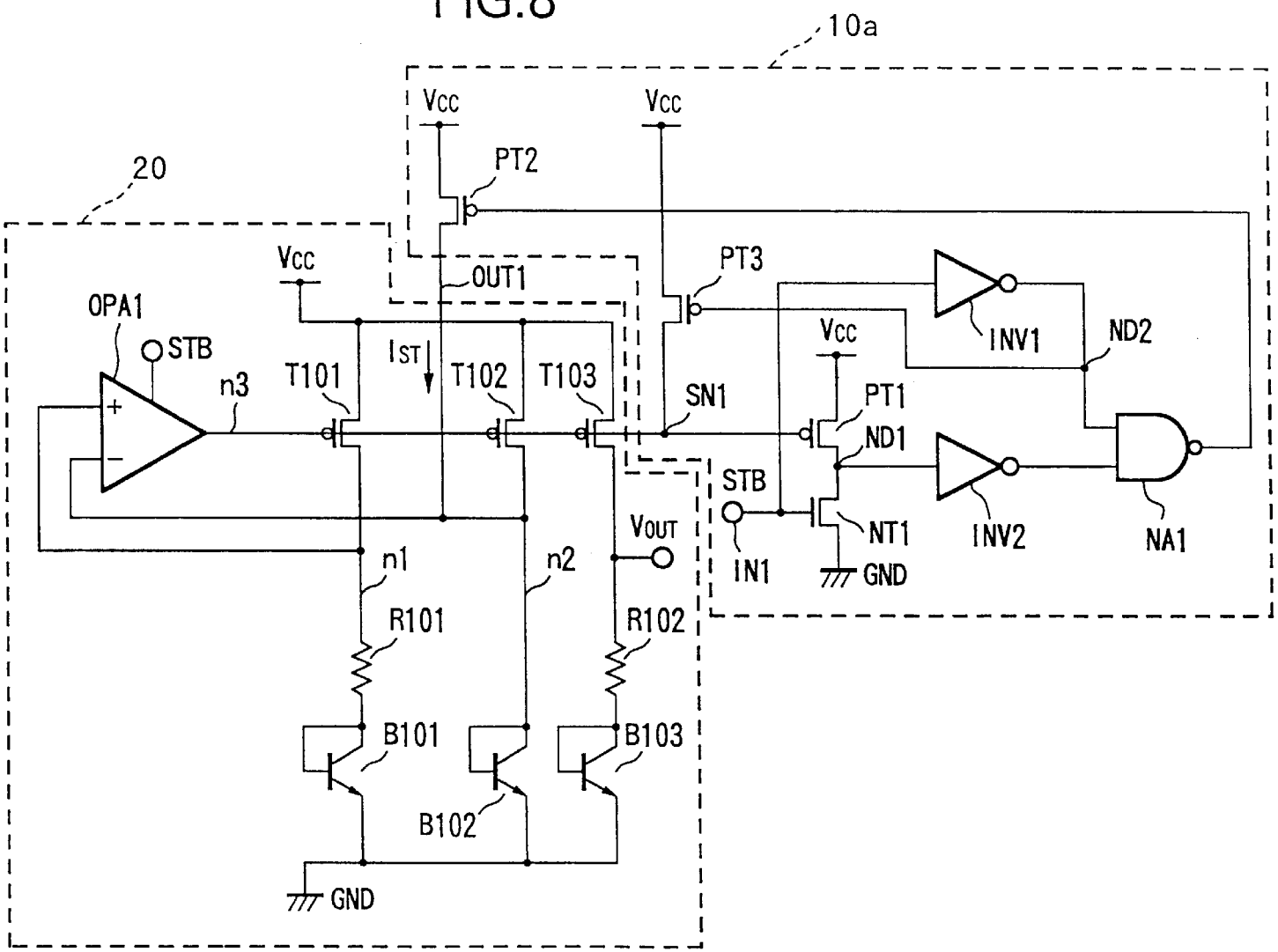
FIG. 8 is a circuit diagram of a voltage supply circuit constituting a start-up circuit and a band gap reference voltage circuit.

FIG. 8 is a circuit diagram of a voltage supply circuit constituted by using a start-up circuit according to an embodiment of the present invention.

As illustrated, the voltage supply circuit of the present embodiment is constituted by the start-up circuit 10*a* shown in the first embodiment and a band gap reference voltage circuit 20. The output terminal OUT1 of the start-up circuit 10*a* is connected to the node n2 of the band gap reference voltage circuit 20, while the signal terminal SN1 is connected to the node n3, that is, the connection node formed by the output terminal of the operational amplifier OPA1 and the gates of the transistor T101, T102, and T103.

The standby signal STB which is held at the high level at the time of idling and at the low level after the voltage supply circuit starts operations is input to the input terminal IN1.

The start-up circuit 10*a* supplies the start-up current $I_{ST}$ from the output terminal OUT1 to the node n2 of the band gap reference voltage circuit 20 in response to the trailing edge of the standby signal STB, while controls the timing for supplying the start-up current $I_{ST}$ by confirming the operational status of the band gap reference voltage circuit 20. Concretely, after the band gap reference voltage circuit 20 starts and the voltage of the node n3 falls and reaches a level enough to turn on the transistor PT1, the start-up circuit stops the supply of the start-up current $I_{ST}$ by turning off the transistor PT2. For this reason, after the supply of the start-up current $I_{ST}$ stops, the band gap reference voltage operates normally and supplies a constant voltage free of power supply voltage and temperature dependency under the control of the feedback loop formed by the operational amplifier OPA1.

First Embodiment of Band Gap Reference Voltage Circuit

Figure 9:
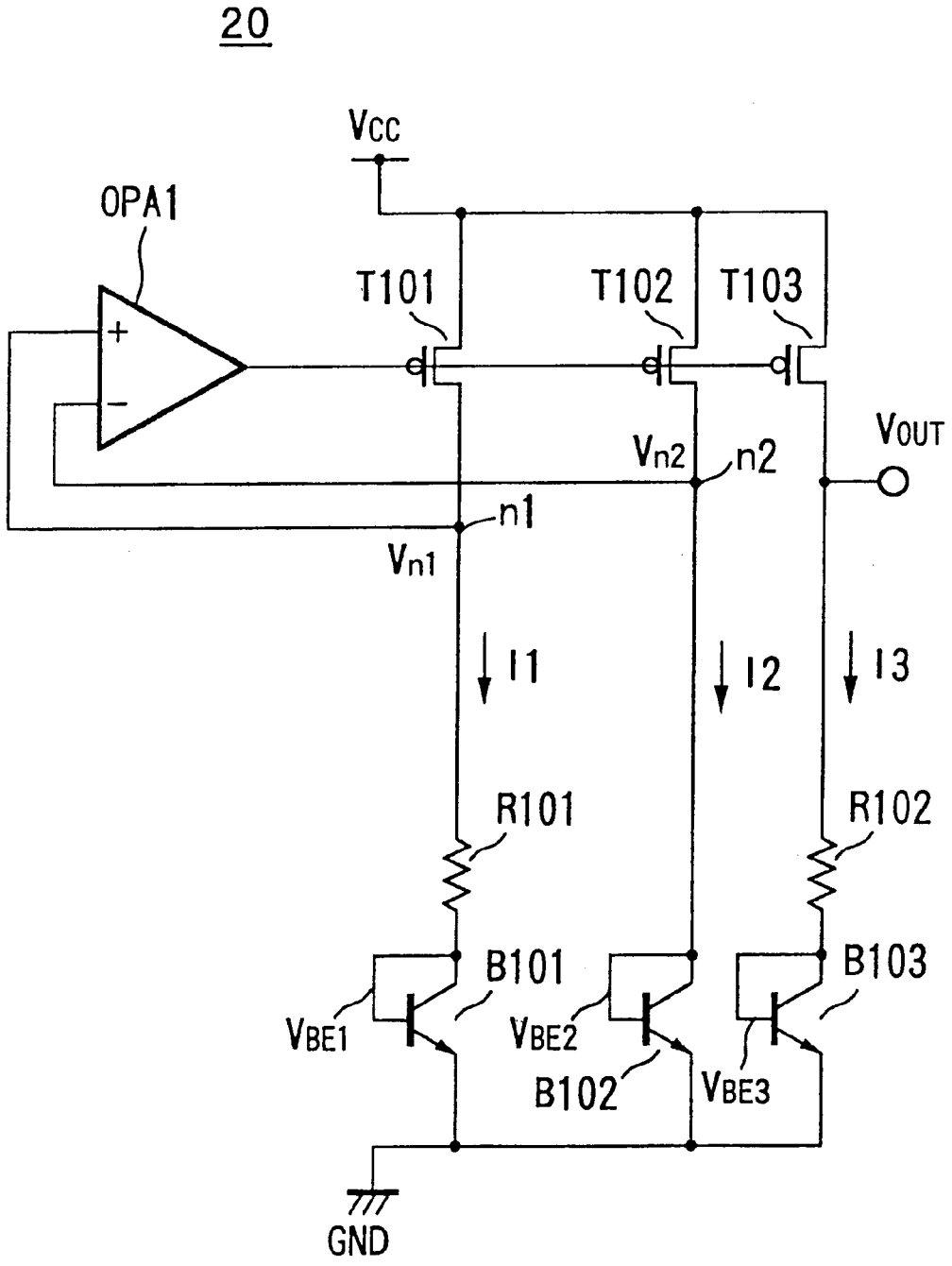
FIG. 9 is a circuit diagram of a first embodiment of the band gap reference voltage circuit.

FIG. 9 is a circuit diagram of a band gap reference voltage circuit 20 according to a first embodiment.

As illustrated, the band gap reference voltage circuit 20 is constituted by an operational amplifier OPA1, pMOS transistors T101, T102, and T103, resistors R101, R102, and diode-connected npn transistors B101, B102, and B013.

The transistor T101, the resistor R101, and the diode-connected transistor B101 are connected in series between the supply line of the power supply voltage $V_{CC}$ and the ground potential GND, the transistor T102 and the diode-connected transistor B102 are connected in series between the supply line of the power supply voltage $V_{CC}$ and the ground potential GND, and the transistor T103, the resistor R102, and the diode-connected transistor B101 are connected in series between the supply line of the power supply voltage $V_{CC}$ and the ground potential GND.

The gates of the transistor T101, T102, and T103 are connected together to the output terminal of the operational amplifier OPA1 and output currents I1, I2, and I3 in response to the output signal of the operational amplifier OPA1.

The positive input terminal (+) of the operational amplifier OPA1 is connected to the connection node n1 of the transistor T101 and the resistor R101, while the negative input terminal (−) is connected to the connection node n2 of the transistor T102 and B102. The output terminal of the band gap reference voltage circuit 20 is formed by the connection node of the transistor T103 and the resistor R102. A constant voltage $V_{OUT}$ free of power supply voltage and temperature dependency is output from this output terminal during normal operation.

The output signal of the operational amplifier OPA1 is supplied to the gates of the transistors T101, T102, and T103. For this reason, a feedback loop is formed by the operational amplifier OPA1. By the control of the feedback loop, during normal operation, the currents I1, I2, and I3 of the transistors T101, T102, and T103 are controlled so that the voltages of the nodes n1 and n2 are maintained equally.

Note that since the transistors T101, T102, and T103 are formed with equal channel widths and other characteristics, during the normal operation, the currents I1, I2, and I3 flowing in these transistors become equal due to the control of the feedback loop formed by the operational amplifier OPA1.

The emitter size of the transistor B101 is formed 10 times larger than that of the transistor B102. Note that the emitter sizes of the transistors B102 and B103 are equal.

Below, an explanation of the operational principle of the band gap reference voltage circuit 20 will be given using equations.

The base-to-emitter voltage $V_{BE}$ of a bipolar transistor is calculated by the following equation:

$$V_{BE}=V_T \ln(I_C/I_S) \tag{1}$$

Here, $V_T$=kT/q, k is Boltzmann's constant, T is the absolute temperature, q is an electron charge, $I_C$ is the collector current, and $I_S$ is a constant current value proportional to the emitter size of the transistor.

In the band gap reference voltage circuit 20, since during normal operation, the voltages $V_{n1}$ and $V_{n2}$ of the nodes n1 and n2 have a relation of $V_{n1}=V_{n2}$, the next equation is obtained:

$$I_1R_1+V_{BE1}=V_{BE2} \tag{2}$$

Here, $V_{BE1}$ and $V_{BE2}$ are the base-to-emitter voltages of the transistors B101 and B102, and $R_1$ is the resistance of the resistor R1. The next equation is obtained by entering equation (1) into equation (2).

$$I_1R_1=V_T \ln(I_1/I_{S1})=V_T \ln(I_2/I_{S2}) \tag{3}$$

In equation (3), $I_1$ and $I_2$ are the values of the currents I1 and I2 flowing in the transistors T101 and T102. As described above, the emitter size of the transistor B101 is formed 10 times larger than that of the transistors B102 and B103. Namely, $I_{S1}$=10$I^{S2}$. By entering this into equation (3), the current $I_1$ can be derived as follows:

$$I_1=V_T(\ln 10)/R_1 \tag{4}$$

Further, if the current value of the current I3 of transistor T103 is $I_3$, $I_1=I_2=I_3$ stands. Accordingly, the output voltage $V_{OUT}$ of the band gap reference voltage circuit 20 is given as:

$$V_{OUT}=V_{BE3}+R_2V_T(\ln 10)/R_1 \tag{5}$$

In equation (5), $V_{BE3}$ is the base-to-emitter voltage of the transistor B103, and $R_2$ is the resistance of the resistor R2.

In equation (5), the base-to-emitter voltage $V_{BE3}$ shows a negative temperature characteristic, for example, $d(V_{BE3})/dT=-2$ mV/K. For this reason, by setting the temperature characteristic of 2 mV/K to the second term of equation (5), the temperature dependency of the output voltage $V_{OUT}$ can be completely eliminated. Note that since $V_T$=kT/q, the condition for eliminating the temperature dependency of the output voltage $V_{OUT}$ is given by the following equation:

$$\ln 10(R_2/R_1)(k/q)=2 \text{ mV/K} \tag{6}$$

That is, when the resistances $R_1$ and $R_2$ of the resistors R101 and R102 satisfy the relation shown in equation (6), the output voltage $V_{OUT}$ is a constant voltage value which is independent of any temperature fluctuation. When the relation shown in equation (6) is met, at a temperature T of 300 K (27° C.), the second term ($R_2V_T(\ln 10)/R_1$) of the right side of equation (6) is equal to 0.6. Furthermore, when the base-to-emitter voltage of the transistor B103 is 0.65V, the output voltage $V_{OUT}$ of the band gap reference voltage circuit 20 is 1.25V. Namely, by selecting the resistance R1 and R2 of the resistors R101 and R102 in a way meeting equation (6), a constant voltage $V_{OUT}$ completely free of power supply voltage and temperature dependency can be obtained by the band gap reference voltage circuit illustrated in FIG. 9.

FIGS. 10A to 10H are timing charts of the operation of the voltage supply circuit illustrated in FIG. 9 at the time of start-up. Below, an explanation of the operation of the voltage supply circuit of the present embodiment will be given by referring to FIGS. 10A to 10H and FIG. 8.

As shown in FIG. 10A, at the time of idling (standby) of the circuit operation, the standby signal STB is held at the high level, for example, the level of the power supply voltage $V_{CC}$, while after the circuit starts operation, the standby signal STB is held at the low level, for example, the ground potential GND.

As shown in FIG. 10B, after a little time elapses from the trailing edge of the standby signal STB, the node ND2, namely, the output terminal of the inverter INV1, switches from the low level to the high level. Further, as shown in FIG. 10E, the output signal of the NAND gate NA1 switches to the low level, and accordingly the start-up circuit 10*a* starts to supply the start-up current $I_{ST}$ to the band gap reference voltage circuit 20, from the trailing edge of the standby signal STB. According to this, as shown in FIG. 10F, the voltage $V_{n2}$ of the node n2 starts to rise.

FIG. 10G illustrates the output voltage of the operational amplifier OPA1, namely, the voltage of the node n3, in response to the voltages $V_{n1}$ and $V_{n2}$ of the nodes n1 and n2. As illustrated, along with the rise of the voltage $V_{n2}$ of the node n2, the voltage of the node n3 falls. When the voltage of the node n3 falls and reaches a voltage enough to turn the transistor PT1 in the start-up circuit 10*a* on, the transistor PT1 turns on. According to this, as shown in FIG. 10C, the node ND1 is charged and the voltage thereof rises.

As illustrated in FIG. 10D, when the voltage of the node ND1 exceeds the logic threshold voltage of the inverter INV2, the output of the inverter INV2 inverts. According to this, since the output of the NAND gate NA1 inverts to the high level, the transistor PT2 turns off and the supply of the start-up current $I_{ST}$ stops. After that, the band gap reference voltage circuit 20 is controlled by the feedback loop formed by the operational amplifier OPA1, the output voltage of the operational amplifier OPA1 is held reliably, and, accordingly, the voltages $V_{n1}$ and $V_{n2}$ of the nodes n1 and n2 are substantially held constantly, and a constant voltage $V_{OUT}$ free of power supply voltage and temperature dependency is output from the band gap reference voltage circuit 20.

Note that in the band gap reference voltage circuit 20, when the voltage $V_{n2}$ of the node n2 happens to be higher than the voltage $V_{n1}$ of the node n1, the band gap reference voltage circuit 20 can start normal operation without the start-up circuit 10*a* operating much at all.

Figure 11:
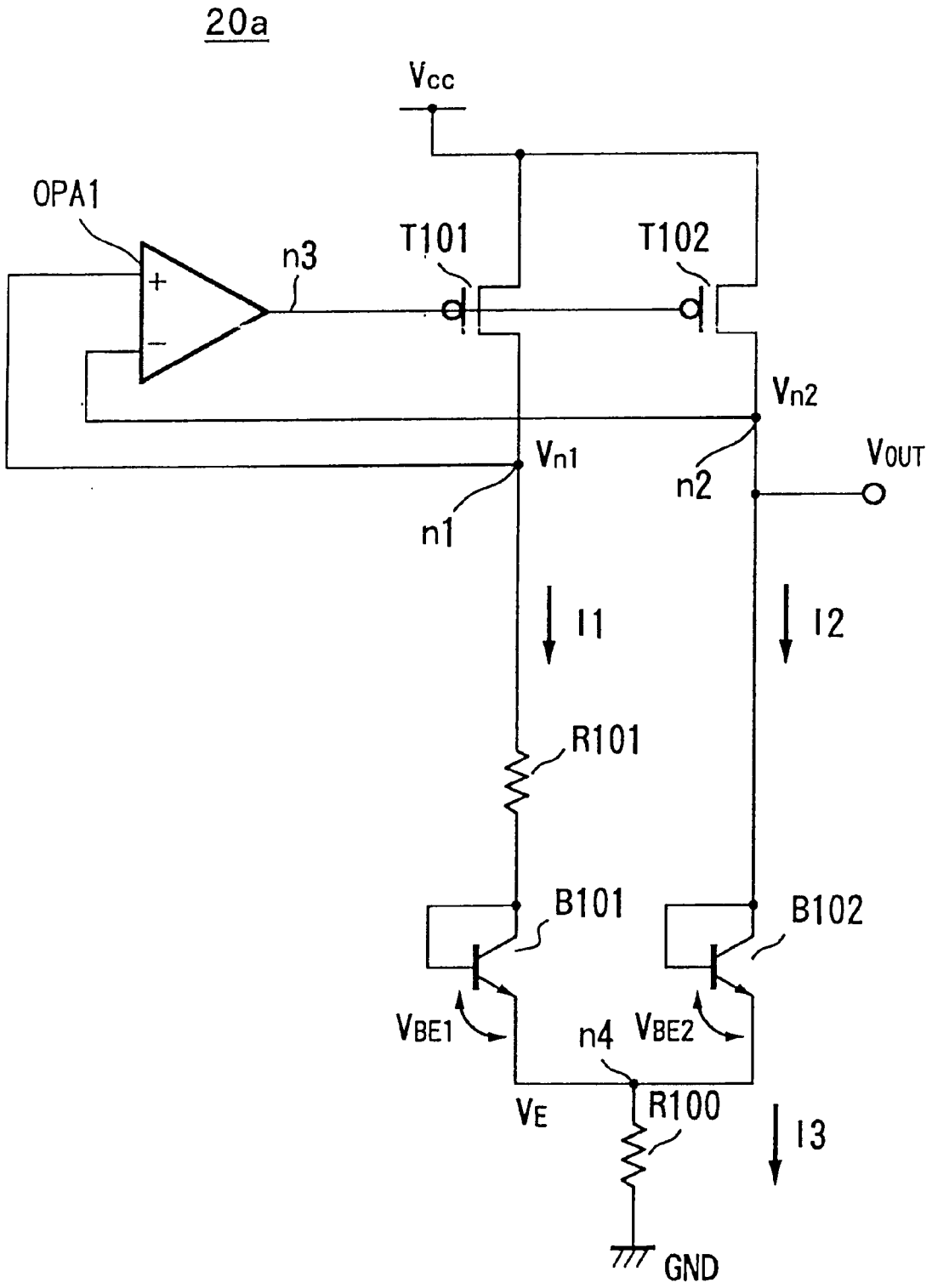
FIG. 11 is a circuit diagram of a second embodiment of the band gap reference voltage circuit.

As described above, according to the voltage supply circuit of the present embodiment, the voltage supply circuit is constituted by the start-up circuit 10*a* and the band gap reference voltage circuit 20. At the time of start-up, by supplying the start-up current $I_{ST}$ by the start-up circuit 10*a*, the band gap reference voltage circuit 20 starts reliably. After the band gap reference voltage circuit 20 starts operation, the voltage of the output signal of the operational amplifier OPA1 starts falling. When the voltage of the output signal reaches a voltage enough to turn the pHOS transistor PT1 in the start-up circuit 10*a* on, the supply of the start-up current $I_{ST}$ is stopped. The band gap reference voltage circuit operates under the control of the feedback loop formed by the operational amplifier OPA1 and supplies a constant voltage free of power supply voltage and temperature dependency Second Embodiment of Band Gap Reference Voltage Circuit FIG. 11 is a circuit diagram of a band gap reference voltage circuit according to a second embodiment.

As illustrated, the band gap reference voltage circuit 20 is constituted by an operational amplifier OPA1, pMOS transistors T101, T102, and T103, resistors R101, R102, and diode-connected npn transistors B101 and B102.

The transistor T101, the resistor R101, and the diode-connected transistor B101 are connected in series between the supply line of the power supply voltage Vcc and the node n4, while the transistor T102 and the diode-connected transistor B102 are connected in series between the supply line of the power supply voltage $V_{CC}$ and the node n4.

The transistors T101 and T102 are connected at their gates to the output terminal of the operational amplifier OPA1 and output currents I1 and I2 in response to the output signal of the operational amplifier OPA1.

The positive input terminal (+) of the operational amplifier OPA1 is connected to the connection node n1 of the transistor T101 and the resistor R101, while the negative input terminal (−) is connected to the connection node n2 of the transistors T102 and B102. Further, the output terminal of the band gap reference voltage circuit 20*a* is formed by the node n2. A constant voltage $V_{OUT}$ free of power supply voltage and temperature dependency is output from the output terminal during normal operation.

The output signal of the operational amplifier OPA1 is supplied to the gates of the transistors T101 and T102. For this reason, a feedback loop is formed by the operational amplifier OPA1. Under the control of the feedback loop, during normal operation, the currents I1 and I2 of the transistors T101 and T102 are controlled so that the voltages of the nodes n1 and n2 become equal.

Here, if the channel widths of the transistors T101 and T102 are set substantially equal, the output currents I1 and I2 of these transistors are equal too.

The emitter size of the transistor B101 is formed 10 times larger than that of the transistor B102.

Compared with the band gap reference voltage circuit 20 shown in FIG. 9, in the band gap reference voltage circuit 20*a* of the present embodiment, the transistor T103, the resistor R102, and the transistor B101 are omitted and the reference voltage $V_{OUT}$ is output from the connection node n2 of the transistors B101 and T102. Furthermore, the connection node of the emitters of the transistors B101 and B102 is grounded through the transistor R100. Below, an explanation of the operation of the band gap reference voltage circuit 20*a* of the present embodiment will be given in comparison with FIG. 9.

In the band gap reference voltage circuit 20 of the first embodiment illustrated in FIG. 9, the voltages of the nodes n1 and n2 are input to the operational amplifier OPA1, and the output signal of the operational amplifier OPA1 is supplied to the gates of the translators T101; T102, and T103, The voltages $V_{n1}$ and $V_{n2}$ of the nodes n1 and n2 are controlled to be substantially equal by feedback control. For example, the voltages $V_{n1}$ and $V_{n2}$ of the nodes n1 and n2 are controlled to be 0.7V. and the output voltage $V_{OUT}$ is held at about 1.25V. For this reason, In the transistors T101, T102, and T103 with the same control voltage supplied to the gates thereof, the source-to-drain voltages $V_{ds}$ of the transistors T101 nd T102 are equal to each other, while the source-to-drain voltage of the transistor T103 is different.

Due to the difference between the source-to-drain voltages, there is a small difference ΔI between the currents flowing in the transistors T101 (T102) and T103. Since the source-to-drain voltages of the transistors T101, T102, and T103 change in response to the fluctuation of the power supply voltage Vcc, the current difference ΔI fluctuates and the output voltage $V_{OUT}$ has a small power supply voltage dependency.

Below, a more concrete explanation of the power supply voltage dependency of the output voltage $V_{OUT}$ will be given using equations. The relation shown in the next equation is satisfied between the current $I_{ds}$ and the source-to-drain voltage $V_{ds}$ of a MOS transistor:

$$I_{ds}=k(V_{gs}-V_{th})^2(1+\lambda V_{ds}) \quad (7)$$

In equation (7), $V_{gs}$ is the gate-to-source voltage of the MOS transistor, $V_{th}$ is the threshold voltage, k is a constant determined in accordance with the transistor size, and λ is a proportional constant showing the dependency of $V_{ds}$ on $I_{ds}$. Note that, in equation (7), the dependency of $V_{ds}$ on $I_{ds}$ is approximated by an equation of the first degree, but strictly speaking the approximation equation includes second and higher degree terms.

In an ideal case where the currents of the transistors T101 and T103 are equal, the output voltage $V_{OUT}$ can be expressed by the following equation:

$$\begin{aligned} V_{OUT} &= V_{BE3} + I_3 R_2 \\ &= V_{BE3} + I_1 R_2 \end{aligned} \quad (8)$$

In equation (8), $V_{BE3}$ is the base-to-emitter voltage of the transistor B103, $I_1$ and $I_3$ are the values of the currents I1 and I3, and $R_2$ expresses the resistance of the resistor R102. In practice, since there is a difference ΔI of the currents I1 and I2, the output voltage $V_{OUT}$ can be expressed by the following equation:

$$\begin{aligned} V_{OUT} &= V_{BE3} + I_3 R_2 \\ &= V_{BE3} + (I_1 + \Delta I) R_2 \end{aligned} \quad (9)$$

Since the differential current Δl has power supply voltage dependency, the output voltage $V_{OUT}$ has power supply voltage dependency.

Furthermore, in the band gap reference voltage circuit 20 shown in FIG. 9, since the output currents I1 and I2 of the transistors T101 and T102 flow to the ground potential GND, the power consumption is great.

In the band gap reference voltage circuit 20*a* of the second embodiment shown in FIG. 11, since the voltages $V_{n1}$ and $V_{n2}$ of the nodes n1 and n2 are held equally by the operational amplifier OPA1, ($V_{n1}-V_E=V_{n2}-V_E$) stands. Here, $V_E$ is the voltage of the node n4. Accordingly, the following equation stands:

$$I_1 R_1 + V_{BE1} = V_{BE2} \quad (10)$$

Here, $I_1$ is the current value of the current I1, $R_1$ is the resistance of the resistor R101, and $V_{BE1}$ and $V_{BE2}$ express the base-to-emitter voltages of the transistors B101 and B102, respectively. Namely, the following equations stand:

$$V_{BE1}=V_T \ln(I_{C1}/I_{S1}) \quad (11)$$

$$V_{BB2}=V_T \ln(I_{C2}/I_{S2}) \quad (12)$$

By entering equations (11) and (12) into equation (10) and further using $I_{C1}=I_1$, $I_{C2}=I_2$, and the fact that the emitter size of the transistor B101 is formed 10 times larger than that of the transistor B102, namely, $I_{S1}=10I_{S2}$, the following equation can be obtained:

$$I=V_T(\ln 10)/R_1 \quad (13)$$

Here, the resistance of the resistor R100 is assumed to be $R_{10}$. The current I3 flowing in the resistor R100 is equal to the sum of the currents I1 and I2. Namely, if the current value of the current I3 is $I_3$, $I_3=(I_1+I_2)=2I_1$ can be obtained. For this reason, the output voltage $V_{OUT}$ is obtained by the following equation:

$$\begin{aligned} V_{OUT} &= V_{BE2} + I_3 R_{10} \\ &= V_{BE2} + 2V_T(\ln 10) R_{10}/R_1 \end{aligned} \quad (14)$$

The base-to-emitter voltage $V_{BE2}$ of the transistor has a negative temperature dependency, for example, $d(V_{BE2})/dT=2$ mV/K. For this reason, by setting the second term of the right side of equation (14) as 2 mV/K, the temperature dependency of the output voltage $V_{OUT}$ can be completely eliminated. Note that since $V_T=kT/q$, the condition for eliminating the temperature dependency of the output voltage $V_{OUT}$ can be given by the following equation:

$$2(\ln 10)(R_{10}/R_1)(k/q)=2 \text{ mV/K} \quad (15)$$

When the resistors R100 and R101 satisfy the condition given in equation (15), the output voltage $V_{OUT}$ is independent of temperature fluctuation and at a constant voltage value. Note that when equation (15) is satisfied and the temperature is 300 K (27° C.), the second term on the right side of equation (14) becomes $(2V_T(\ln 10)R_{10}/R_1)=0.6$V. Furthermore, if the base-to-emitter voltage $V_{BE3}$ of the transistor B103 is 0.65V. the output voltage $V_{OUT}$ of the band gap reference voltage circuit 20 is 1.25V according to equation (14).

As described above, in the band gap reference voltage circuit 20 of the present embodiment, a constant output voltage $V_{OUT}$ not dependent on temperature fluctuation can be obtained. Furthermore, during normal operation, the drain potentials of the transistors T101 and T102 are controlled to be equal under the feedback control of the operational amplifier OPA1. Therefore, since the drain-to-source voltages $V_{ds}$ of the transistors T101 and T102 are controlled to be equal, the currents I1 and I2 flowing in these transistors are constantly held equal. Consequently, the temperature dependency of the output voltage $V_{OUT}$ can be suppressed.

Third Embodiment of Band Gap Reference Voltage Circuit

Figure 12:
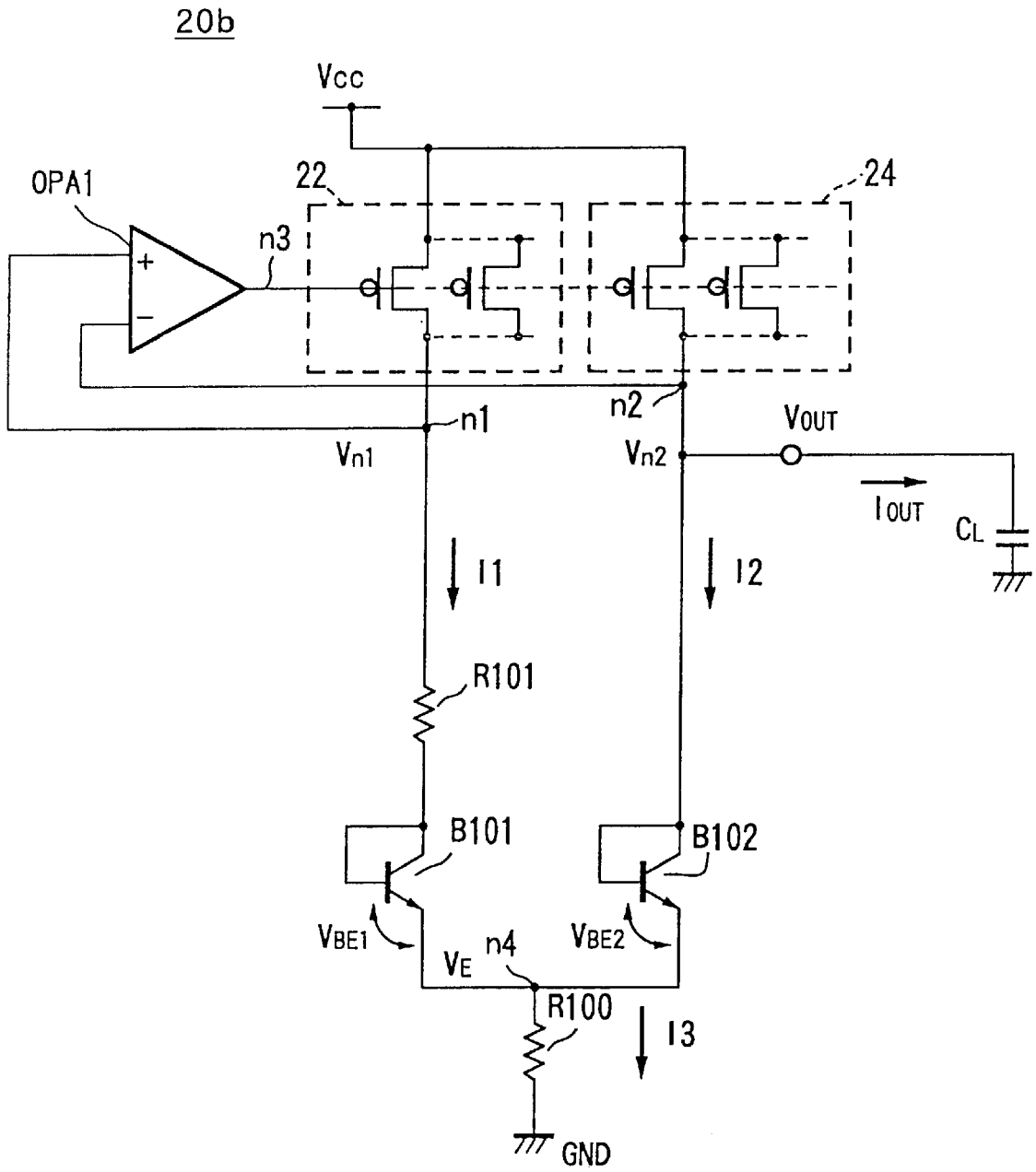
FIG. 12 is a circuit diagram of a third embodiment of the band gap reference voltage circuit.

FIG. 12 is a circuit diagram of a band gap reference voltage circuit according to a third embodiment.

As illustrated, the band gap reference voltage circuit 20*b* of the present embodiment is constituted by transistor groups 22 and 24 each formed by a plurality of pMOS transistors, an operational amplifier OPA1, resistors R101, R102, and diode-connected npn transistors B101 and B102.

As illustrated, the band gap reference voltage circuit 20*b* of the present embodiment differs from the band gap reference voltage circuit 20*a* shown in FIG. 11 in the point that, instead of the transistors T101 and T102, the transistor groups 22 and 24 each formed by a plurality of MOS transistors connected in parallel are provided. The transistor group 22, for example, is constituted by m (m is a natural number) number of pMOS transistors. These transistors are connected in parallel between the supply line of the power supply voltage $V_{CC}$ and the node n1. In substantially the same way, the transistor group 24, for example, is constituted by n (n is a natural number) number of pMOS transistors. These transistors are connected in parallel between the supply line of the power supply voltage $V_{CC}$ and the node n2.

The gates of the transistors constituting the transistor groups 22 and 24 are connected to the output terminal of the operational amplifier OPA1, namely, the node n3.

The other parts of the band gap reference voltage circuit 20*b* are substantially the same as those of the band gap reference voltage circuit 20*a* illustrated in FIG. 11. For example, the positive input terminal (+) and the negative input terminal (−) are connected to the nodes n1 and n2. respectively. The resistor R101 and the diode-connected transistor B101 are connected in series between the node n1 and n4, while the diode-connected transistor B102 is connected between the node n2 and n4. Further, the node n4 is grounded through the resistor R100.

The sizes, for example, the widths of the channels of the transistors constituting the transistor groups 22 and 24 are all the same. Furthermore, the emitter sizes of the transistors B101 and B102 are the same too.

In the band gap reference voltage circuit 20*b* constituted in the above way, the output currents of the transistor groups can be controlled, by setting the number of the transistors of the transistor groups 22 and 24 appropriately. For example, here, assume the number of transistors of the transistor group 22 is 1, while the number of transistors of the transistor group 24 is 10. That is, if m=1 and n=10, the current values $I_1$ and $I_2$ of the output currents I1 and 12 of the transistor groups 22 and 24 have the relation of $10I_1=I_2$. Based on this, the current values I1 and I2 can be found as follows.

The voltages $V_{n1}$ and $V_{n2}$ of the nodes n1 and n2 are held equal under the control of the operational amplifier OPA1. Namely. ($V_{n1}-V_E=V_{n2}-V_E$) stands. For this reason, equations (10) to (12) described above are satisfied by the band gap reference voltage circuit 20*b* of the present embodiment. However, in the present embodiment, since the emitters of the transistors B101 and B102 are the same size, $I_{S1}=I_{S2}$. On the other hand, since $I_{C1}=I_1$ and $I_{C2}=I_2$, $I_{C2}=10I_{C1}$. Based on these conditions, the currents I1 and I2 can be derived by the following equations:

$$I_1=V_T(\ln 10)/R_1 \tag{16}$$

$$I_2=10V_T(\ln 10)/R_1 \tag{17}$$

That is, $I_2=10I_1$. Consequently, the output voltage $V_{OUT}$ is given by the following equation:

$$\begin{aligned} V_{OUT} &= V_{BE2} + I_3 R_{10} \\ &= V_{BE2} + 11 I_1 R_{10} \\ &= V_{BE2} + 11 V_T(\ln 10) R_{10} / R_1 \end{aligned} \tag{18}$$

In equation (18), $V_{BE2}$ has a negative temperature dependency, for example, a temperature dependency of −2 mV/K. Since $V_T$ has a positive temperature dependency, by setting the resistances $R_{10}$ and $R_1$ of the resistors R100 and R101 appropriately, the ratio of the current values of the currents I1 and I2 is able to be freely set. For this reason, for example, by setting the number of the transistors of the transistor group 24 greater, the output current 12 of the transistor group can be controlled to be greater. As shown in FIG. 12, by setting the current 12 greater, the output current $I_{OUT}$ supplied to the load circuit becomes greater, for example, as illustrated, in the case when a capacitive load is driven, the charge current $C_L$ to the capacitive load becomes greater and the rising characteristic of the load can be improved. Furthermore, as shown in equation (18), since a coefficient 11 is added to the second term on the right side of the output voltage $V_{OUT}$, the resistance $R_{10}$ of the resistor R100 can be set smaller and the area of the layout can be reduced.

Note that, as described above, in the band gap reference voltage circuit 20*b* of the present embodiment, by appropriately setting the number of the transistors of the transistor groups 22 and 24 constituted by pluralities of transistors having the same channel size and other characteristics, the output currents I1 and I2 from the transistor groups 22 and 24 can be controlled. Here, of course, the same effect can be achieved by appropriately setting the channel sizes of the transistors constituting the transistor groups.

Further, substantially the same effect as in the present embodiment using the transistor groups 22 and 24 can be achieved by appropriately setting the channel sizes of the transistors T101 and T102 of the band gap reference voltage circuit 20*a* according to the second embodiment shown in FIG. 11. Furthermore, in the above description, the emitter sizes of the diode-connected transistors B101 and B102 were regarded to be equal, however, the emitter sizes of these transistors can be set differently, for example, the emitter size of the transistor B101 can be set to be k times larger than that of the transistor B102. In this case, the second term ln(10) on the right side of equation (18) expressing the output voltage $V_{OUT}$ becomes ln(10k). By appropriately setting the emitter size of the transistors B101 and B102 in this way, the coefficient of the second term on the right side of equation (18) can be changed, accordingly the resistance $R_{10}$ of the resistor R100 can be reduced and the layout area can be reduced in some cases.

Fourth Embodiment of Band Gap Reference Voltage Circuit

Figure 13:
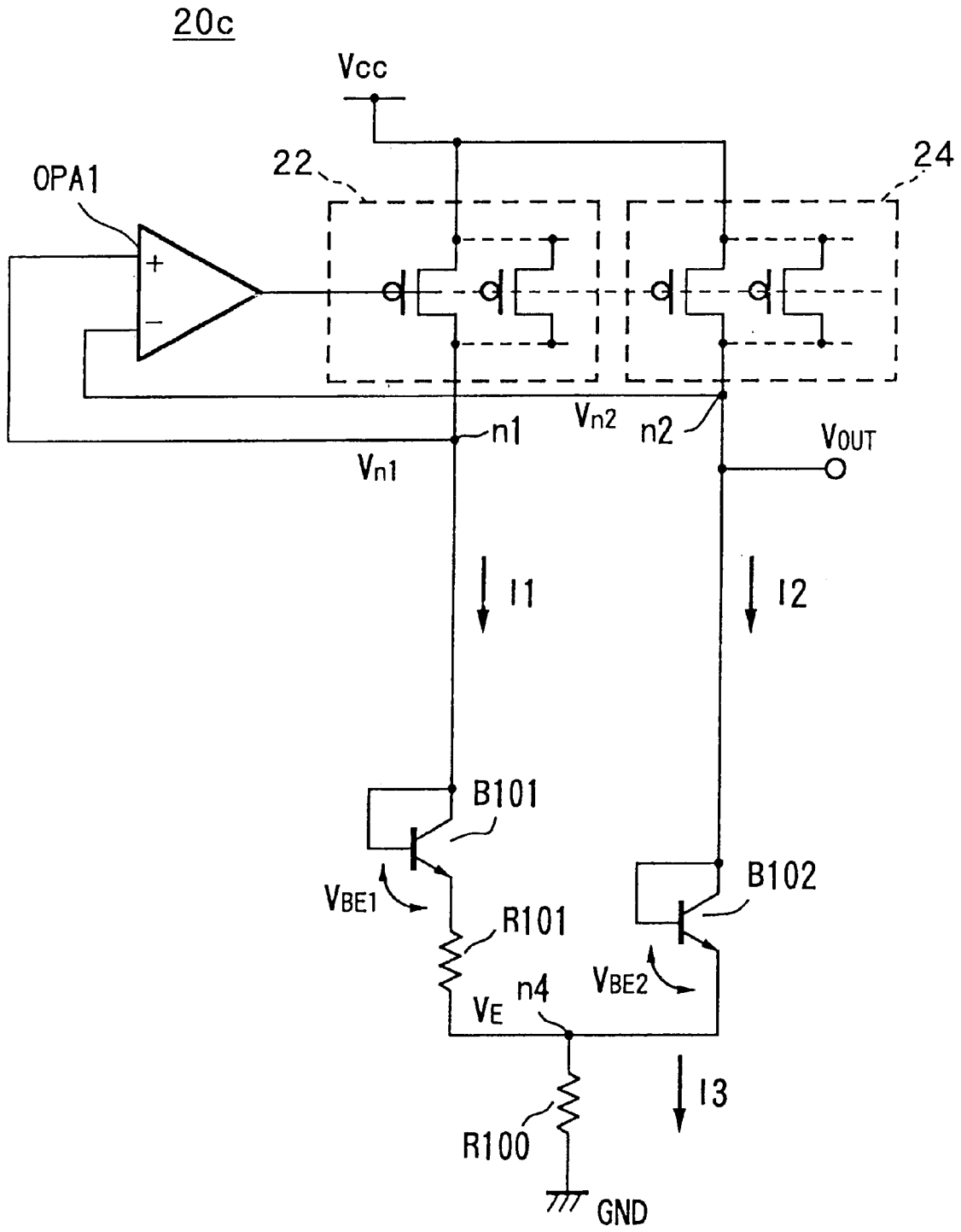
FIG. 13 is a circuit diagram of a fourth embodiment of the band gap reference voltage circuit.

FIG. 13 Is a circuit diagram of a band gap reference voltage circuit according to a fourth embodiment.

As illustrated, the band gap reference voltage circuit 20*a* of the present embodiment is constituted by transistor groups 22 and 24 each formed by a plurality of PMOS transistors, an operational amplifier OPA1, resistors R101, R102, and diode-connected npn transistors B101 and B102.

The band gap reference voltage circuit 20*c* of the present embodiment is substantially the same as the band gap reference voltage circuit 20*b* of the third embodiment expect that the resistor R101 and the diode-connected transistor B101 are switched with each other. Therefore, in the band gap reference voltage circuit 20*b* of the third embodiment, one terminal of the resistor R101 is connected to the node n1, while the other terminal thereof is connected to the collector and the base of the transistor B101. Contrary to this, in the band gap reference voltage circuit 20*c* of the present embodiment, the connection point of the base and the collector of the transistor B101 is connected to the node n1, and the resistor R101 is connected between the emitter of the transistor B101 and the node n4.

As explained above, the band gap reference voltage circuit 20*a* of the present embodiment is substantially the same as the band gap reference voltage circuit 20*b* of the third embodiment expect for the difference of the connections. Here, the general equation for calculating the output voltage $V_{OUT}$ is found while defining the numbers of the transistors of the transistor groups 22 and 24 as m and n.

Assume that the sizes of the transistors constituting the transistor groups 22 and 24 are equal and, further, the sizes of the transistors B101 and B102 are set the same. That is, the current values $I_1$ and $I_2$ of the output current I1 and I2 are in the relation of the following equation:

$$I_1/m=I_2/n \quad nI_1=mI_2 \tag{19}$$

Namely, $I_2=(n/m)I_1$. In the transistors B101 and B102, since $I_{C1}=I_1$ and $I_{C2}=I_2$ and, furthermore, $I_{S1}=I_{S2}$, according to equations (10) to (12), the currents $I_1$ and $I_2$ can be found by the following equations:

$$I_1=V_T(\ln(n/m))/R_1 \tag{20}$$

$$I_2=(n/m)V_T(\ln(n/m))/R_1 \tag{21}$$

Since the current I3 flowing in the resistor RIOO is the sum of the currents I1 and I2, $I_3=I_1+I_2=(m+n)I_1/m$. According to this, the output voltage $V_{OUT}$ is given by the following equation:

$$\begin{aligned} V_{OUT} &= V_{BE2} + I_3R_{10} \\ &= V_{BE2} + (m+n)V_T(\ln(n/m))R_{10}/(R_1m) \end{aligned} \tag{22}$$

For example, in the band gap reference voltage circuit 20*b* of the third embodiment described above, when m=1 and n=10, the output voltage $V_{OUT}$ is given as $V_{OUT}=V_{BE2}+11V_T\ln(10)R_{10}/R_1$.

By setting the resistance $R_{10}$ and $R_1$ of the resistors R100 and R101 appropriately, the temperature dependency of the output voltage $V_{OUT}$ can be eliminated. Furthermore, it is clear from equation (22) that the output voltage $V_{OUT}$ is independent of the power supply voltage. Furthermore, in equation (22). since the coefficient (m+n)/m is added to the right side, by setting the numbers m and n of transistors appropriately, the resistance of the resistor R100 can be set smaller and the layout area can be reduced.

Note that, in the above description above, the emitter sizes of the diode-connected transistors B101 and B102 are regarded to be equal, however, the ratio of the emitter sizes of the transistors B101 and B102 can be set appropriately. For example, by setting the emitter size of the transistor B101 to be k times that of the transistor B102, in the second term on the right side of equation (22), ln(n/m) becomes ln(nk/m). According to this, the coefficient added to $R_{10}/R_1$ changes. Therefore, by setting the ratio of the emitter sizes of the transistors B101 and B102 appropriately, the resistance $R_{10}$ of the resistor R100 can be set smaller and the layout area can.be reduced.

Fifth Embodiment of Band Gap Reference Volta e Circuit

Figure 14:
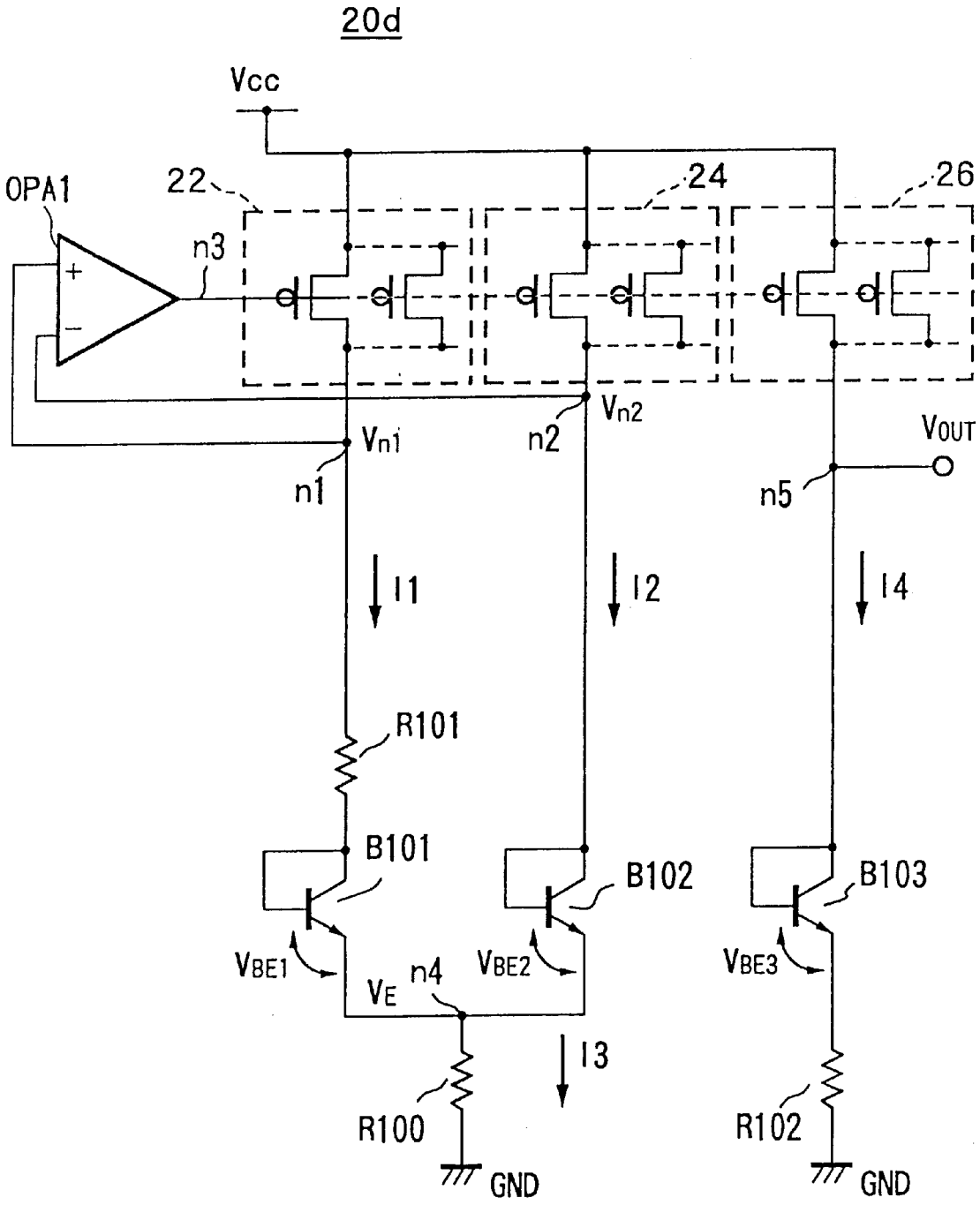
FIG. 14 is a circuit diagram of a fifth embodiment of the band gap reference voltage circuit.

FIG. 14 is a circuit diagram of a band gap reference voltage circuit according to a fifth embodiment.

As illustrated, the band gap reference voltage circuit 20*d* of the present embodiment is constituted by transistor groups 22, 24, and 26 each formed by a plurality of pMOS transistors, an operational amplifier OPA1, resistors R101, R102, and R100, and diode-connected npn transistors B101, B102 and B103.

As illustrated, in the band gap reference voltage circuit 20*d* of the present embodiment, the part constituted by the transistor groups 22 and 24, the operational amplifier OPA1, the transistors B101 and B102, and the resistors R100 and R101 is substantially the same as that of the band gap reference voltage circuit 20*b* of the third embodiment illustrated in FIG. 12. That is, the present embodiment can be regarded as the band gap reference voltage circuit 20*b* of the third embodiment plus the transistor group 26, the transistor B103, and the resistor R102.

The transistor group 26 is constituted by a plurality of, for example, j (j is a natural number) number of, pMOS transistors. These transistors are connected in parallel between the supply line of the power supply voltage $V_{CC}$ and the node n5. The gates thereof are connected to the output terminal of the operational amplifier OPA1, namely, the node n3. The diode-connected transistor B103 and the resistor R102 are connected in series between the node n5 and the ground potential GND. Note that the order of connection of the transistor B103 and the resistor R102 is not specially limited.

Here, assume that the channels of the transistors constituting the transistor groups 22, 24, and 26 are the same size and, further, the emitter sizes of the diode-connected transistors B101, B102, and B103 are equal. If the numbers of transistors of the transistor group 22 and 24 are defined as m and n, in the same way as the band gap reference voltage circuit 20*c* of the fourth embodiment described above, the equations (20) and (21) stand.

Further, in the present embodiment, the current value of the output current I4 of the transistor group 26 is regarded as $I_4$, and the resistance of the resistor R102 is regarded as R2. As described above, since the number of the transistors constituting the transistor group 26 is J, $I_4/I_1=j/m$ stands. Based on this condition, the output voltage $V_{OUT}$ is given by the following equation:

$$\begin{aligned} V_{OUT} &= V_{BE3} + I_4R_2 \\ &= V_{BE3} + jV_T(\ln(n/m))R_2/(R_1m) \end{aligned} \tag{23}$$

In equation (23), $V_{BE3}$ has a negative temperature dependency, for example, a temperature dependency of −2 mV/K. On the other hand, since $V_T$ has a positive temperature dependency, by appropriately setting the resistances $R_2$ and $R_1$ of the resistors R102 and R101, the temperature dependency of the output voltage $V_{OUT}$ can be eliminated. Furthermore, it is clear from equation (23) that the output voltage $V_{OUT}$ is independent of the power supply voltage.

In this way, according to the band gap reference voltage circuit 20*d* of the present embodiment, a stable constant voltage $V_{OUT}$ free from dependency on the temperature and the power supply voltage can be supplied.

Since the circuit part for supplying the output voltage $V_{OUT}$ is provided independent of the feedback loop for voltage control, there is no influence on the feedback loop no matter what load is added. Consequently, a stable output voltage $V_{OUT}$ free from the influence of the characteristic of the load circuit can be supplied.

Note that, in the embodiments described above, voltage supply circuits constituted by start-up circuits and band gap reference voltage circuits were explained as examples, however, it is clear that the start-up circuit according to the present invention can be applied to not only band gap reference voltage circuits, but also other functional circuits. For example, the start-up circuit of the present invention can be applied when supplying a start-up current to a voltage control oscillator (VCO) in a PLL circuit to start the VCO etc. at the time of start-up.

While the invention has been described with reference to specific embodiments chosen for purposes of illustration, it should be apparent that numerous modifications could be made thereto by those skilled in the art without departing from the basic concept and scope of the invention.

What is claimed is:

1. A start-up circuit for supplying a start-up current to a predetermined functional circuit to start the functional circuit, comprising:

a start-up current supply means for supplying the start-up current to the functional circuit in response to a start-up signal;

a voltage generating means for supplying the start-up current in response to the start-up signal; and a start-up control means for stopping the supply current by the start-up current supply means when the voltage of a predetermined operational node in said functional circuit reaches a predetermined reference value.

2. A start-up circuit as set forth in claim 1, further comprising:

a bistable circuit receiving the start-up signal as a first signal and the voltage of the operational node of the functional circuit as a second signal and outputting an output signal having a first state or a second state, respectively, in response to the first signal and the second signal and a gate circuit outputting a signal which energizes or de-energizes the start-up current supply means, in response to a result of a logical operation of the start-up signal and the output signal of the bistable circuit.

3. A start-up circuit as set forth in claim 2, wherein the bistable circuit includes a first transistor and a second transistor connected in series between a supply terminal of a predetermined voltage and a reference potential line, the voltage of the operational node of the functional circuit is supplied to the gate of the first transistor, and the start-up signal is supplied to the gate of the second transistor.

4. A start-up circuit as set forth in claim 2, wherein the start-up current supply means comprises a switching circuit connected between a supply line of a power supply voltage and an input terminal of the start-up current and turns on or off to connect or disconnect between the supply line of the power supply voltage and the input terminal in response to the output signal of the gate circuit.

5. A start-up circuit as set forth in claim 4, wherein the switching circuit is constituted by a transistor having the output signal of the gate circuit supplied to the control terminal thereof.

6. A start-up circuit as set forth in claim 2, further comprising a delay circuit for delaying the output signal of the bistable circuit by exactly a predetermined delay time and supplying the delayed signal to the gate circuit.

7. A start-up circuit as set forth in claim 6, wherein the delay circuit is constituted by an even number of inverters connected in series.

8. A start-up circuit as set forth in claim 6, wherein the delay circuit comprises:

a resistor connected between an input terminal and an output terminal thereof and a capacitor connected between the output terminal and a reference potential line.

9. A start-up circuit for supplying a start-up current to a predetermined functional circuit to start the functional circuit, comprising:

a start-up current supply means for supplying the start-up current to the function circuit in response to a start-up signal and a start-up control means for stopping the supply current by the start-up current supply means when the voltage of a predetermined operational node reaches a predetermined reference value, wherein the functional circuit comprises:

a first current supply transistor connected between a supply line of a power supply voltage and a first node, a first resistor and a first diode connected in series between the first node and a reference potential line, the first diode being in a forward direction toward the reference potential line, a second current supply transistor connected between the supply line of the power supply voltage and a second node, a second diode connected between the second node and the reference potential line, the second diode being in a forward direction toward the reference potential line, a third current supply transistor connected between the supply line of the power supply voltage and a third node, a second resistor and a third diode connected in series between the third node and the reference potential line, the third diode being in a forward direction toward the reference potential line, an amplifier with a first input terminal connected to the first node, and supplying a voltage signal in response to the difference between the input signals of the first and the second input terminals to the control terminals of the first, second and the third transistors, wherein at the time of start-up, the start-up current, from the start-up circuit is supplied to the second node, and the output voltage of the operational amplifier is input to the start-up control means as the voltage of the operational node.

10. A start-up circuit as set forth in claim 9, wherein the current supply transistors are constituted boy field effect transistors.

11. A start-up circuit for supplying a start-up current to a predetermined functional circuit to start the functional circuit, comprising:

a start-up current supply means for supplying the start-up current to the function circuit in response to a start-up signal and a start-up control means for stopping the supply current by the start-up current supply means when the voltage of a predetermined operational node reaches a predetermined reference value, wherein the functional circuit comprises:

a first current supply transistor connected between a supply line of a power supply voltage and a first node, a second current supply transistor connected between the supply line of the power supply voltage and a second node, a first resistor and a first diode connected in series between the first node and a third node, the first diode being in a forward direction toward the third node, a second diode connected between the second node and the third node, the second diode being in a forward direction toward the third node, a second resistor connected between the third node and a reference potential line, an amplifier with a first input terminal connected to the first node, with a second input terminal connected to the second node, and supplying a voltage signal in response to the difference between the input signals of the first and the second input terminals to the control terminals of the first and the second current supply transistors, wherein at the time of start-up, the start-up current from the start-up circuit is supplied to the second node, and the output voltage of the operational amplifier is input to the start-up control means as the voltage of the operational node.

12. A start-up circuit for supplying a start-up current to a predetermined functional circuit to start the functional circuit, comprising:

a start-up current supply means for supplying the start-up current to the functional circuit in response to a start-up signal and a start-up control means for stopping the supply of the start-up current by the start-up current supply means when the voltage of a predetermined operational node reaches a predetermined reference value, wherein the functional circuit comprises:

a first transistor group constituted by m (m is a natural number) number of current supply transistors connected in parallel between a supply line of a power supply voltage and a first node, a second transistor group constituted by n (n is a natural number) number of current supply transistors connected in parallel between the supply line of the power supply voltage and a second node, a first resistor and a first diode connected in series between the first node and a third node, the first diode being in a forward direction toward the third node, a second diode connected between the second node and the third node, the second diode being in a forward direction toward a third node, a second resistor connected between the third node and a reference potential line, an amplifier with a first input terminal connected to the first node, with a second input terminal connected to the second node, and supplying a voltage signal in response to the difference between the input signals of the first and the second input terminals to the control terminals of the transistors of the first and the second transistor groups, wherein at the time of start-up, the start-up current form the start-up circuit is supplied to the second node, and the output voltage of the operational amplifier is input to the start-up control means as the voltage of the operational node.

13. A start-up circuit for supplying a start-up current to a predetermined functional circuit to start the functional circuit, comprising:

a start-up current supply means for supplying the start-up current to the function circuit in response to a start-up signal and a start-up control means for stopping the supply current by the start-up current supply means when the voltage of a predetermined operational node reaches a predetermined reference value, wherein the functional circuit comprises:

a first transistor group constituted by m (m is a natural number) number of current supply transistors connected in parallel between a supply line of a power supply voltage and a first node, a second transistor group constitutes by n (n is a natural number) number of current supply transistors connected in parallel between the supply line of the power supply voltage and a second node, a first resistor and a first diode connected in series between the first node and a third node, the first diode being in a forward direction toward the third node, a second diode connected between the second node and the third node, the second node being in a forward direction toward the third node, a second resistor connected between the third node and a reference potential line, a third transistor group constituted by j (j being a natural number) number of the current supply transistors connected in parallel between the supply line of the power supply voltage and a fourth node, a third resistor and a third diode connected in series between the fourth node and the reference potential line, the third diode being in a forward direction toward the potential line, p2 an amplifier with a first input terminal connected to the first node, with a second input terminal connected to the second node, supplying a voltage signal in response to the difference between the input signals of the first and the second input terminals to the control terminals of the transistors of the first, the second, and the third transistor groups, wherein at the time of start-up, the start-up current from the start-up circuit is supplied to the second node, and the output voltage of the operational amplifier is input to the start-up control means as the voltage of the operational node.

14. A voltage supply circuit, comprising:

a first current supply transistor connected between a supply line of a power supply voltage and a first node, a first resistor and a first diode connected in series between the first node and a reference potential line, the first diode being in a forward direction toward the reference potential line, a second current supply transistor connected between the supply line of the power supply voltage and a second node, a second diode connected between the second node and the reference potential line, the second diode being In a forward direction toward the reference potential line, a third current supply transistor connected between the supply line of the power supply voltage and a third node, a second resistor and a third diode connected in series between the third node and the reference potential line, the third diode being in a forward direction toward the reference potential line, an amplifier with a first input terminal connected to the first node, with a second input terminal connected to the second node, and supplying a voltage signal in response to the difference between the input signals of the first and the second input terminals to the control terminals of the first, the second, and the third current supply transistors, a start-up current supply means supplying a start-up current at the time of start-up to the second node in response to a start-up signal, and a start-up control means for stopping the supply of the start-up current when the output voltage of the amplifier reaches a predetermined reference value.

15. A voltage supply circuit as set forth in claim 14, wherein the start-up control means comprises:

a bistable circuit receiving the start-up signal as a first signal and the output voltage of the amplifier as a second signal and outputting an output signal having a first state or a second state respectively in response to the first signal and the second signal and a gate circuit outputting a signal which energizes or de-energizes the start-up current supply means, in response to a result of a logical operation of the start-up signal and the output signal of the bistable circuit.

16. A voltage supply circuit as set forth in claim 15, wherein the bistable circuit includes a first transistor and a second transistor connected in series between a supply line of a power supply voltage and a reference potential line, the output voltage of the amplifier is supplied to the gate of the first transistor, and the start-up signal is supplied to the gate of the second transistor.

17. A voltage supply circuit as set forth in claim 14, wherein the start-up current supply means comprises a switching circuit connected between a supply terminal of a predetermined voltage and the second node and turns on or off to connect or disconnect between the supply terminal of the predetermined voltage and the second node in response to the output signal of the gate circuit.

18. A voltage supply circuit as set forth in claim 17, wherein the switching circuit is constituted by a transistor having the output signal of the gate circuit supplied to the control terminal thereof.

19. A voltage supply circuit as set forth in claim 14, wherein the current supply transistors are constituted by field effect transistors.

20. A voltage supply circuit as set forth in claim 15, further comprising a delay circuit for delaying the output signal of the bistable circuit by exactly a predetermined delay time and supplying the delayed signal to the gate circuit.

21. A voltage supply circuit, comprising:

a first current supply transistor connected between a supply line of a power supply voltage and a first node, a second current supply transistor connected between the supply line of the power supply voltage and a second node, a first resistor and a first diode connected in series between the first node and a third node, the first diode being in a forward direction toward the third node, a second diode connected between the second node and the third node, the second diode being in a forward direction toward the third node, a second resistor connected between the third node and a reference potential line, an amplifier with a first input terminal connected to the first node, with a second input terminal connected to the second node, and supplying a voltage signal in response to the difference between the input signals of the first and the second input terminals to the control terminals of the first and the second current supply transistors, a start-up current supply means supplying a start-up current at the time of start-up to the second node in response to a start-up signal, and a start-up control means for stopping the supply of the start-up current when the output voltage of the amplifier reaches a predetermined reference value.

22. A voltage supply circuit, comprising:

a first transistor group constituted by m (m is a natural number) number of current supply transistors connected in parallel between a supply line of a power supply voltage and a first node, a second transistor group constituted by n (n is a natural number) number of current supply transistors connected in parallel between the supply line of the power supply voltage and a second node, a first resistor and a first diode connected in series between the first node and a third node, the first diode being in a forward direction toward the third node, a second diode connected between the second node and the third node, the second diode being in a forward direction toward the third node, a second resistor connected between the third node and a reference potential line, an operational amplifier with a first input terminal connected to the first node, with a second input terminal connected to the second node, and supplying a voltage signal in response to the difference between the input signals of the first and the second input terminals to the control terminals of the transistors of the first and the second transistor groups, a start-up current supply means supplying a start-up current at the time of start-up to the second node in response to a start-up signal, and a start-up control means for stopping the supply of the start-up current when the output voltage of the amplifier reaches a predetermined reference value.

23. A voltage supply circuit, comprising:

a first transistor group constituted by m (m is a natural number) number of current supply transistors connected in parallel between a supply line of a power supply voltage and a first node, a second transistor group constituted by n (n is a natural number) number of current supply transistors connected in parallel between the supply line of the power supply voltage and a second node, a first resistor and a first diode connected in series between the first node and a third node, the first diode being in a forward direction toward the third node, a second diode connected between the second node and the third node, the second diode being in a forward direction toward the third node, a second resistor connected between the third node and a reference potential line, a third transistor group constituted by j (j is a natural number) number of current supply transistors connected in parallel between the supply line of the power supply voltage and a fourth node, a third resistor and a third diode connected in series between the fourth node and the reference potential line, the third diode being in a forward direction toward the potential line, an amplifier with a first input terminal connected to the first node, with a second input terminal connected to the second node, and supplying a voltage signal in response to the difference between the input signals of the first and the second input terminals to the control terminals of the transistors of the first, the second, and the third transistor groups, a start-up current supply means supplying a start-up current at the time of start-up to the second node in response to a start-up signal, and a start-up control means for stopping the supply of the start-up current when the output voltage of the amplifier reaches a predetermined reference value.

* * * * *

UNITED STATES PATENT AND TRADEMARK OFFICE

CERTIFICATE OF CORRECTION

PATENT NO. : 6,242,898 B1 
DATED : June 5, 2001
INVENTOR(S) : Yasuhide Shimizu and Tomoyuki Nasu It is certified that error appears in the above-identified patent and that said Letters Patent is hereby corrected as shown below:

Column 23,
Line 45, replace “inverters” with -- converters --.

Column 24,
Line 31, replace “boy” with -- by --.

Column 26,
Line 13, delete “p2” and start a new paragraph with -- an --.
Line 38, replace “In” with -- in --.

Signed and Sealed this

Eighth Day of April, 2003

JAMES E. ROGAN
*Director of the United States Patent and Trademark Office*